US007108482B2

(12) United States Patent
Chapman

(10) Patent No.: US 7,108,482 B2
(45) Date of Patent: Sep. 19, 2006

(54) CENTRIFUGAL BLOWER

(75) Inventor: Thomas R. Chapman, Templeton, MA (US)

(73) Assignee: Robert Bosch GmbH, Stuttgart (DE)

( * ) Notice: Subject to any disclaimer, the term of this patent is extended or adjusted under 35 U.S.C. 154(b) by 40 days.

(21) Appl. No.: 10/764,283

(22) Filed: Jan. 23, 2004

(65) Prior Publication Data

US 2005/0163614 A1 Jul. 28, 2005

(51) Int. Cl.
*F01D 5/22* (2006.01)

(52) U.S. Cl. ..... 416/185; 415/206

(58) Field of Classification Search ..... 415/206; 416/175, 183, 185, 187, 186 R; 264/328.1
See application file for complete search history.

(56) References Cited

U.S. PATENT DOCUMENTS 2,422,615 A 6/1947 Halford
3,224,079 A * 12/1965 Dybvig ..... 29/889.4
4,647,271 A 3/1987 Nagai et al.
4,900,228 A 2/1990 Yapp
4,904,158 A * 2/1990 Kun ..... 416/183
5,352,089 A 10/1994 Tokunaga et al.
5,927,947 A 7/1999 Botros
5,944,485 A * 8/1999 Maumus et al. ..... 416/186 R
6,042,335 A 3/2000 Amr
6,168,734 B1 * 1/2001 Botros ..... 264/40.1
6,224,335 B1 * 5/2001 Parisi et al. ..... 415/206
6,402,473 B1 6/2002 Chapman
2002/0106277 A1 8/2002 Chapman

FOREIGN PATENT DOCUMENTS

GB 761937 11/1956

* cited by examiner

*Primary Examiner*—Edward K. Look
*Assistant Examiner*—Devin Hanan
(74) *Attorney, Agent, or Firm*—Michael Best & Friedrich LLP

(57) ABSTRACT

The present invention provides a centrifugal fan including a hub adapted for rotation about a central axis and a plurality of blades arranged about the central axis and coupled for rotation with the hub. Each of the blades includes a curvature in a plane that extends through the blade and is tangent to a cylinder which extends through the blade and is centered along the central axis.

35 Claims, 18 Drawing Sheets

CENTRIFUGAL BLOWER

FIELD OF THE INVENTION

This invention relates generally to centrifugal blowers, and more particularly to centrifugal blowers for use in automotive climate control systems.

BACKGROUND OF THE INVENTION

Centrifugal blowers typically include impellers having a plurality of blades that redirect an incoming airflow toward a radial direction as the airflow moves from the impeller inlet to the impeller outlet. The blades are typically attached to a hub for rotation therewith. The hub typically defines an airflow surface on the base of the impeller to help redirect the incoming airflow.

In automotive climate control applications (i.e., heating, ventilation, and air conditioning), centrifugal impellers may be generally grouped into two categories: a) low cost, one-piece impellers; and b) higher cost, higher efficiency, two-piece impellers. One-piece impellers, because of their lower cost, are generally more prevalent in automotive climate control applications than two-piece impellers. Two-piece impellers are generally used in an automotive climate control application when the need for high efficiency or high pressure capability outweighs any cost disadvantage.

Further, in automotive climate control applications, centrifugal blowers should operate efficiently over a range of operating conditions. For example, duct passages open and close to direct air through different heat exchangers of different flow resistances. Flow resistance typically is greatest in heater and defrost conditions, and least in air conditioning mode. In some instances, the high flow resistance during heater and defrost modes can cause performance and/or noise problems for conventional one-piece impellers, which may be less efficient than the more expensive two-piece impellers, or only capable of producing relatively low pressures compared to the more expensive two-piece impellers.

SUMMARY OF THE INVENTION

The present invention provides, in one aspect, a centrifugal blower including a centrifugal fan having a hub adapted for rotation about a central axis and a first plurality of blades arranged about the central axis. Each of the blades defines a leading edge, a trailing edge, a first side edge extending between the leading edge and the trailing edge, the first side edge being swept from the leading edge in a direction axially away from the leading edge and radially outward toward the trailing edge, a second side edge extending between the leading edge and the trailing edge, a portion of the second side edge integral with at least a portion of the hub, the second side edge being swept from the leading edge in a direction axially away from the leading edge and radially outward toward the trailing edge, an inlet radius defined as an outermost radius of the blade leading edge, a shroud integral with at least a portion of one of the first and second side edges of the first plurality of blades, an intermediate radius defined as an innermost radius of the shroud, a curvature in a first plane, the first plane extending through the blade and tangent to a cylinder which extends through the blade and is centered along the central axis, the cylinder being of a radius greater than a hub radius and less than the inlet radius, and no curvature in a second plane, the second plane extending through the blade and tangent to a cylinder which extends through the blade and is centered along the central axis, the cylinder being of a radius greater than the intermediate radius.

The present invention provides, in another aspect, a centrifugal blower including a centrifugal fan having a hub adapted for rotation about a central axis and a plurality of blades arranged about the central axis and coupled for rotation with the hub. Each of the blades defines a leading edge substantially perpendicular to the central axis, a trailing edge substantially parallel to the central axis, a first side edge extending between the leading edge and the trailing edge, the first side edge being swept from the leading edge in a direction axially away from the leading edge and radially outward toward the trailing edge, a second side edge extending between the leading edge and the trailing edge, the second side edge at least partially integral with the hub, the second side edge being swept from the leading edge in a direction axially away from the leading edge and radially outward toward the trailing edge, an inlet radius defined as the outermost radius of the blade leading edge, and a first shroud integral with at least a portion of the respective first side edges of the plurality of blades. The first shroud includes a cylindrical portion coaxial with the hub, the hub and cylindrical portion defining therebetween a substantially annular, axially-oriented inlet of the fan, the cylindrical portion extending upstream of the intersection of the leading edge of the blade and the first side edge of the blade, and a bell portion radially and axially extending from the cylindrical portion, the bell portion at least partially defining a substantially annular, radially outward-oriented outlet of the fan. Each of the blades also includes an intermediate radius defined as the innermost radius of the first shroud, a curvature in a plane, the plane extending through the blade and tangent to a cylinder which extends through the blade and is centered along the central axis, the cylinder being of a radius greater than the hub radius and less than the inlet radius, and no curvature in a plane, the plane extending through the blade and tangent to a cylinder which extends through the blade and is centered along the central axis, the cylinder being of a radius greater than the intermediate radius. The centrifugal blower also includes a blower housing substantially enclosing the fan, the blower housing defining an inlet opening and a scroll defining an outlet, a motor supported in the blower housing and comprising a drive shaft drivingly connected to the hub, at least one electrical component operatively connected with the motor, a second non-rotating shroud positioned in the blower housing coaxial with the hub, the second non-rotating shroud comprising a surface in closely spaced, facing relationship with the respective second side edges of the plurality of blades and shaped to follow a contour of the respective second side edges of the plurality of blades, the first shroud and second non-rotating shroud at least partially defining therebetween an air passageway between the inlet and outlet of the fan, a heat sink positioned in the second non-rotating shroud and shaped to conform with the contour of the surface of the second non-rotating shroud, the heat sink thermally coupled with the at least one electrical component, a first ring fixed to the blower housing and positioned around the inlet opening of the blower housing, the first ring coaxial with and inside of the cylindrical portion of the first shroud, the first ring at least partially axially overlapping the cylindrical portion of the first shroud, and a second ring fixed to the blower housing and positioned around the inlet opening of the blower housing, the second ring coaxial with and outside of the cylindrical portion of the first shroud, the second ring at least partially axially overlapping the cylindrical portion of the first shroud, a combination of the first ring, second ring, and the cylindrical portion of the first shroud defining a tortuous passageway to substantially restrict airflow discharged from the outlet of the fan from re-entering the inlet of the fan.

The present invention provides, in yet another aspect, a method of manufacturing a one-piece fan including a plurality of blades arranged about a central axis and coupled for rotation with a hub. Each of the blades defines a low-pressure surface, a high-pressure surface, a leading edge, a trailing edge, and first and second side edges extending between the leading edge and the trailing edge. At least a portion of the hub is integral with at least a portion of the respective second side edges of the plurality of blades, and a shroud is integral with at least a portion of the respective first side edges of the plurality of blades. The method includes providing a mold divided into a first mold portion and a second mold portion along a parting line, the first mold portion being movable with respect to the second mold portion along a mold axis, molding a first portion of the respective low-pressure surfaces of the blades in the first mold portion, molding a second portion of the respective low-pressure surfaces of the blades in the second mold portion, and joining the first and second portions of the respective low-pressure surfaces of the blades along a portion of the parting line oriented between about 1 degree and about 90 degrees from the mold axis.

Other features and aspects of the present invention will become apparent to those skilled in the art upon review of the following detailed description, claims and drawings.

BRIEF DESCRIPTION OF THE DRAWINGS

In the drawings, wherein like reference numerals indicate like parts.

Figure 1A:
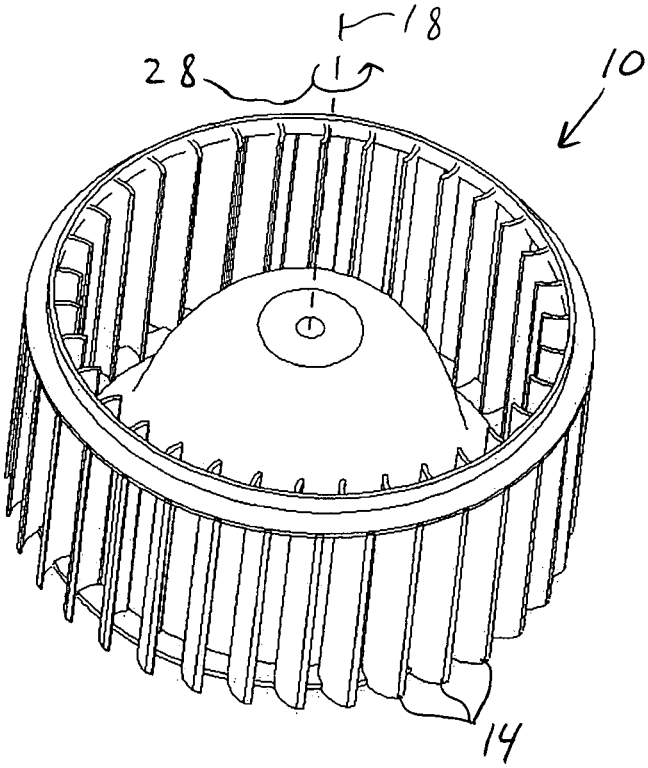
FIG. 1a Prior Art
FIG. 1*a* is a top perspective view of a forward-curved fan.
Figure 2:
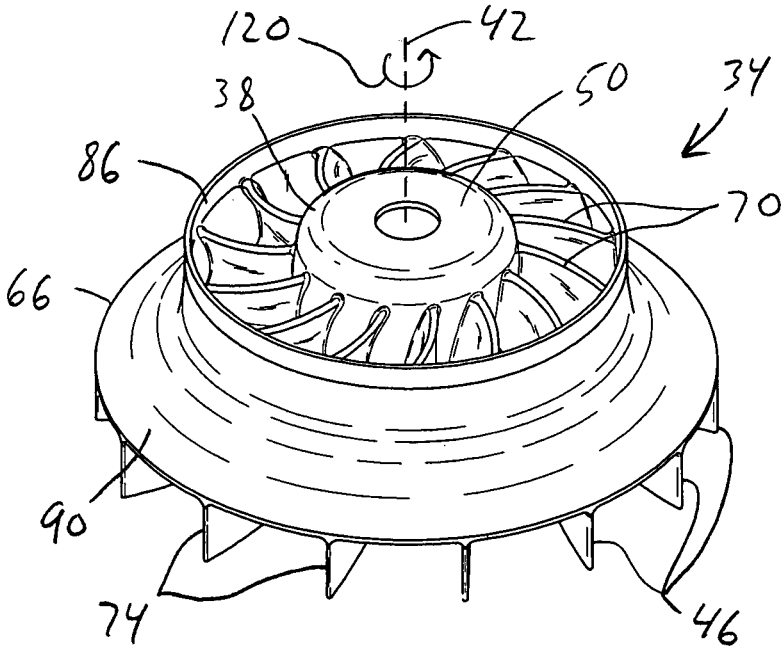
FIG. 2 is a top perspective view of an fan embodying the present invention.

Before any features of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of letters to identify elements of a method or process is simply for identification and is not meant to indicate that the elements should be performed in a particular order.

DETAILED DESCRIPTION

Figure 1B:
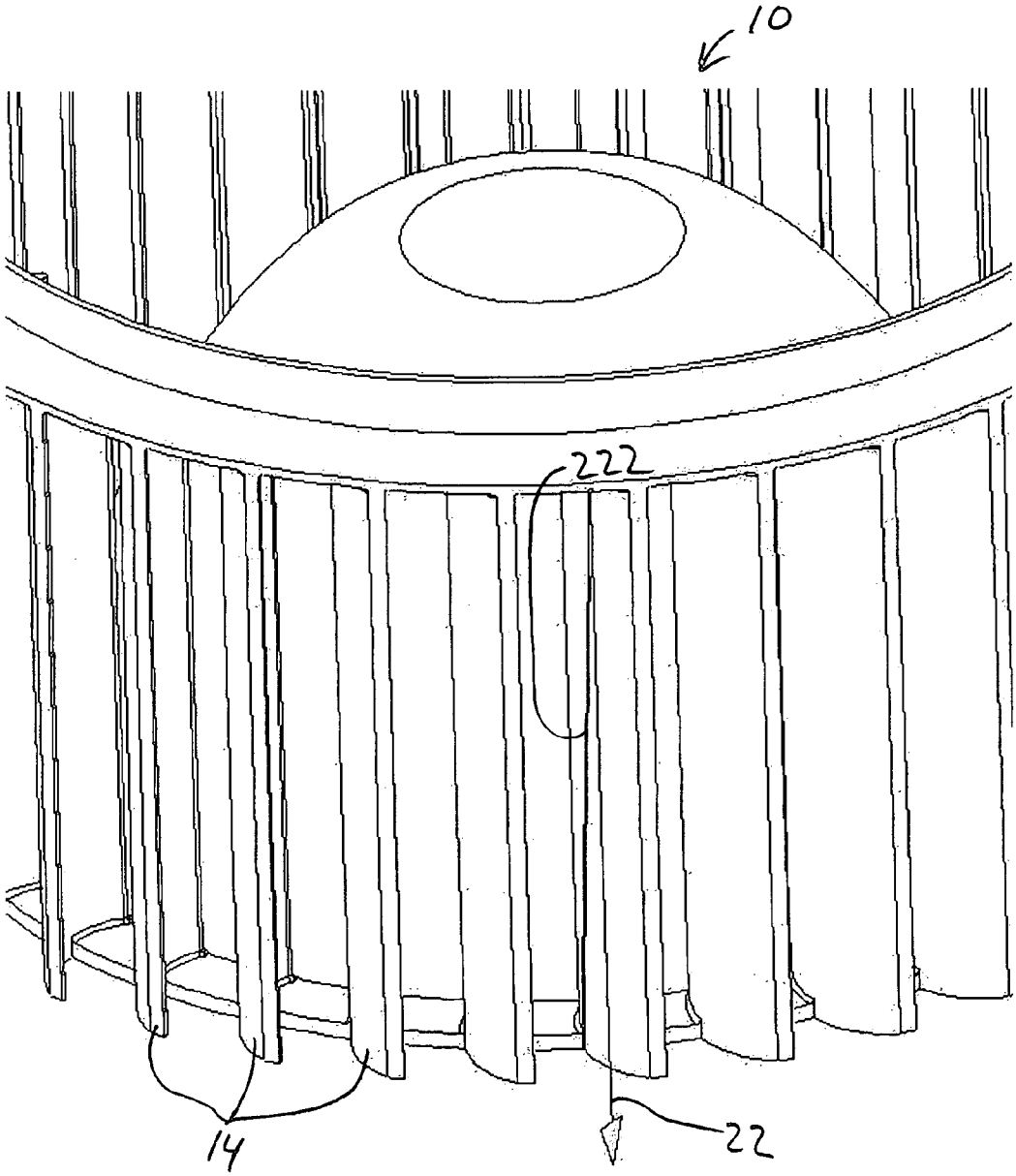
Fig. 1b Prior Art
FIG. 1*b* is an enlarged view of the fan of FIG. 1*a*.

FIG. 1*a* illustrates a typical prior-art, one-piece, forward-curved fan 10. The fan 10 includes a plurality of blades 14 that are formed from a two-dimensional curve. In other words, the only curvature of the blades 14 occurs in a plane that is taken through the blades 14 and that is normal to a rotational axis 18 of the fan 10. The fan 10 is typically manufactured from a plastic material using a molding process (e.g., an injection molding process). The two-dimensional blade forms allow the fan 10 to be molded as one piece using a relatively simple mold separated into two mold halves which may be brought together or separated from one another along a mold axis 22 (see FIG. 1*b*). The parting line on the surface of the blades 14 is substantially parallel to the mold axis 22.

Figure 1C:
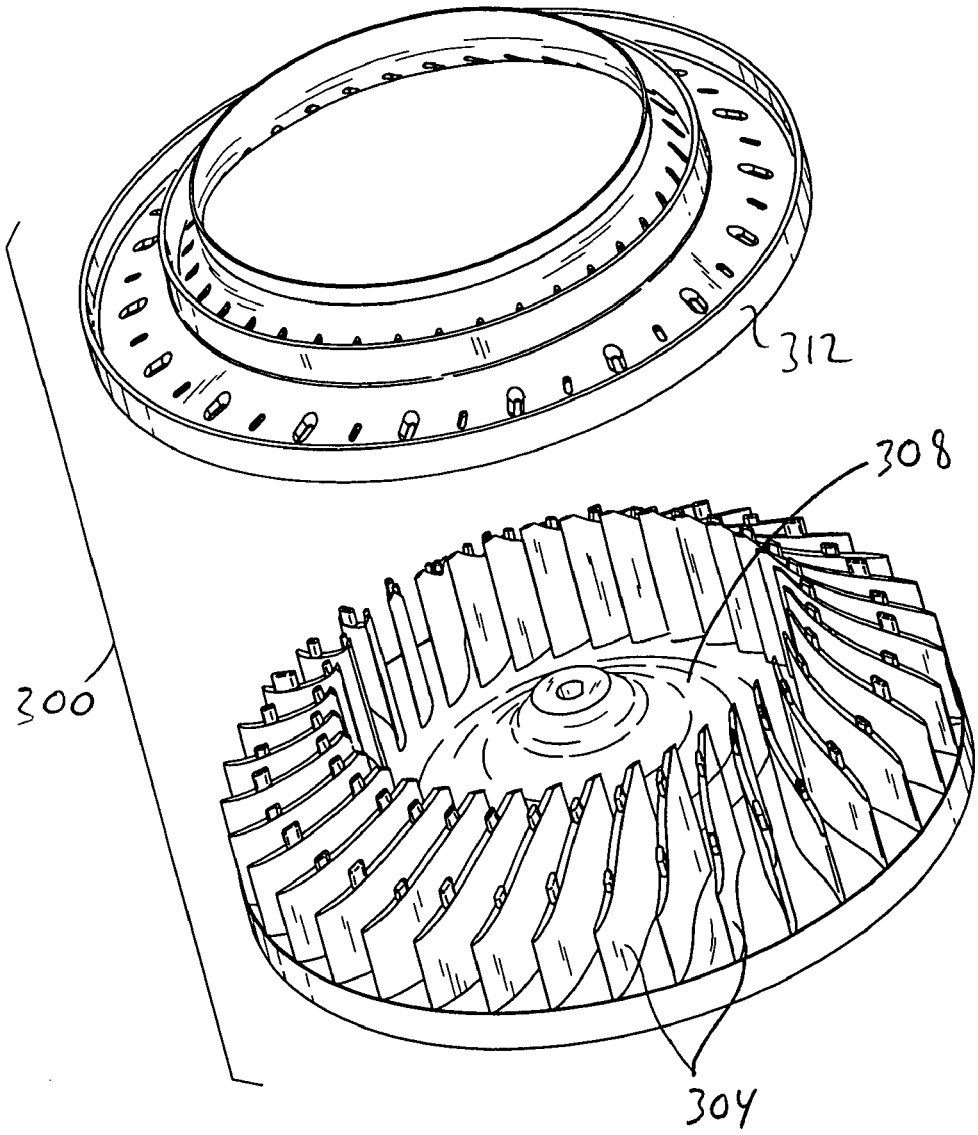
FIG. 1c PRIOR ART
FIG. 1*c* is an exploded top perspective view of a two-piece, backward-curved fan.

FIG. 1*c* illustrates a typical prior art, two-piece, backward-curved fan 300. The fan 300 includes a plurality of blades 304 that are formed from a two-dimensional curve. In other words, the only curvature of the blades 304 occurs in a plane that is taken through the blades 304 and that is normal to a rotational axis of the fan 300. The fan 300 is typically manufactured from a plastic material using a molding process (e.g., an injection molding process). The fan 300 is typically constructed from two parts; a hub part 308 that includes the blades 304, and a shroud part 312 that is affixed in some manner to the ends of the blades 304 opposite the hub. Although this type of fan 300 is generally more efficient than the forward-curved fan 10, the two-piece construction of the fan 300 results in increased manufacturing costs as compared to a typical forward-curved fan 10.

Figure 1D:
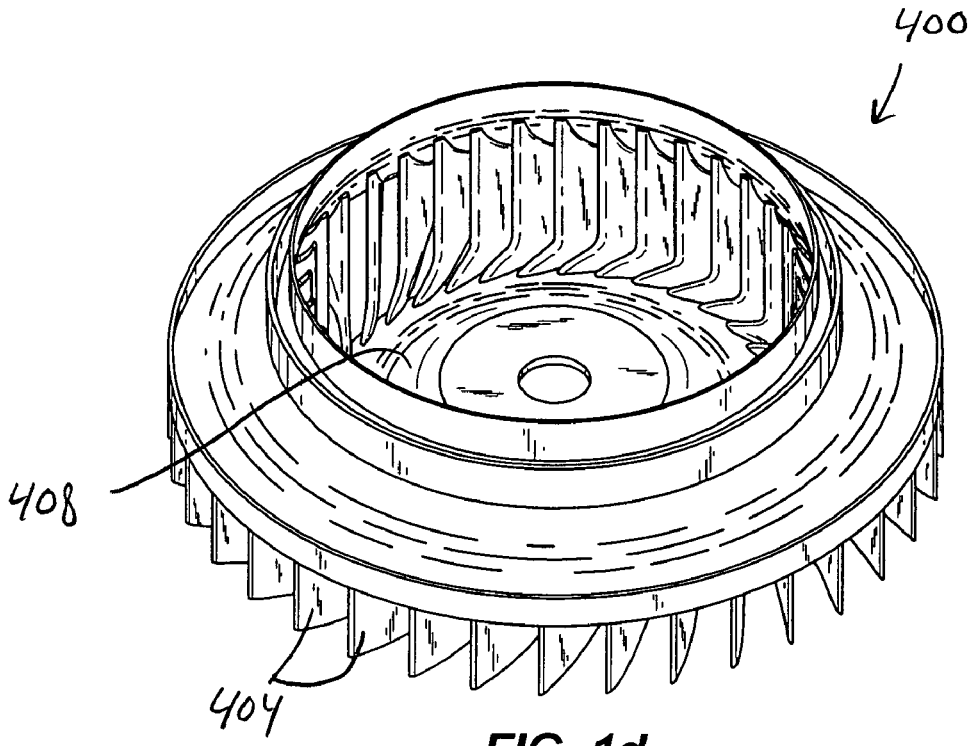
FIG. 1d PRIOR ART
FIG. 1*d* is a top perspective view of a one-piece, backward-curved fan.
Figure 1E:
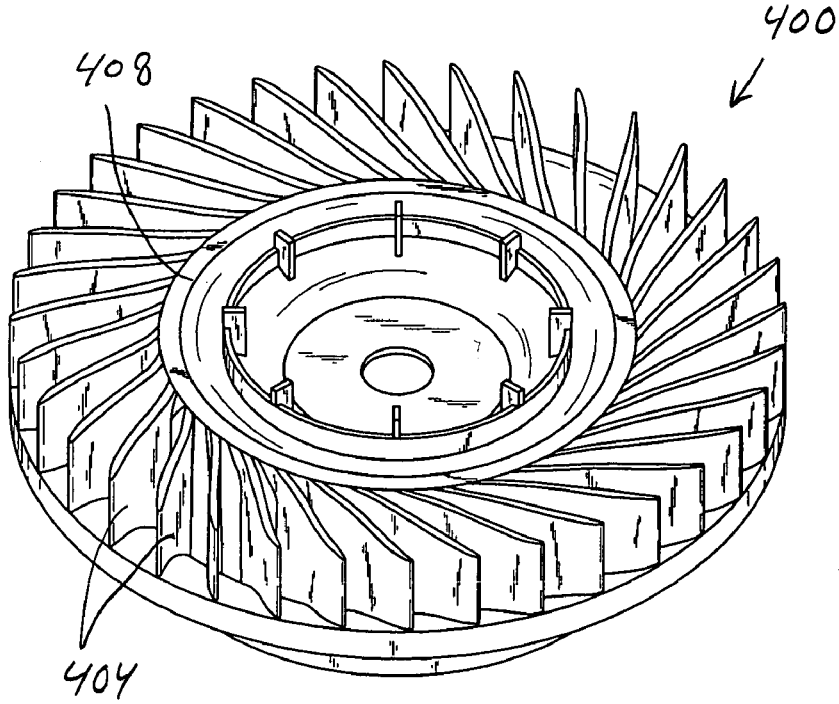
FIG. 1e PRIOR ART
FIG. 1*e* is a bottom perspective view of the one-piece, backward-curved fan of FIG. 1*d*.

FIGS. 1*d* and 1*e* illustrate a one-piece backward-curved fan 400. This fan 400 embodies shroud and blade geometry similar to the two-piece backward-curved fan 300, but for one piece manufacture, a hub 408 extends only to a radius less than the inlet radius of the fan 400, which may be defined as the outermost radius of the blade leading edge of the fan 400. The resulting fan 400 has blades 404 that are attached to the hub 408 over a small portion of their leading edges. When this type of fan 400 is manufactured using an injection molding process, mold parting lines are required near the blade leading edges and must be substantially parallel to the mold axis, similar to the forward curved fan 10 of FIGS. 1*a* and 1*b*. Also, the connection of the hub 408 and the fan blades 404 occurs over a relatively small portion of the blades 404. This small connection area results in a small flow area for injection molded plastic to flow through, complicating the molding process. The small connection area can also lead to inadequate structural integrity in that portion of the fan 400.

Furthermore, all the fan types discussed above (forward-curved fan, two-piece and one-piece backward-curved fan) have blade leading edges that are substantially parallel to the respective axes of rotation of the fans, and at a relatively large radius.

Figure 12:
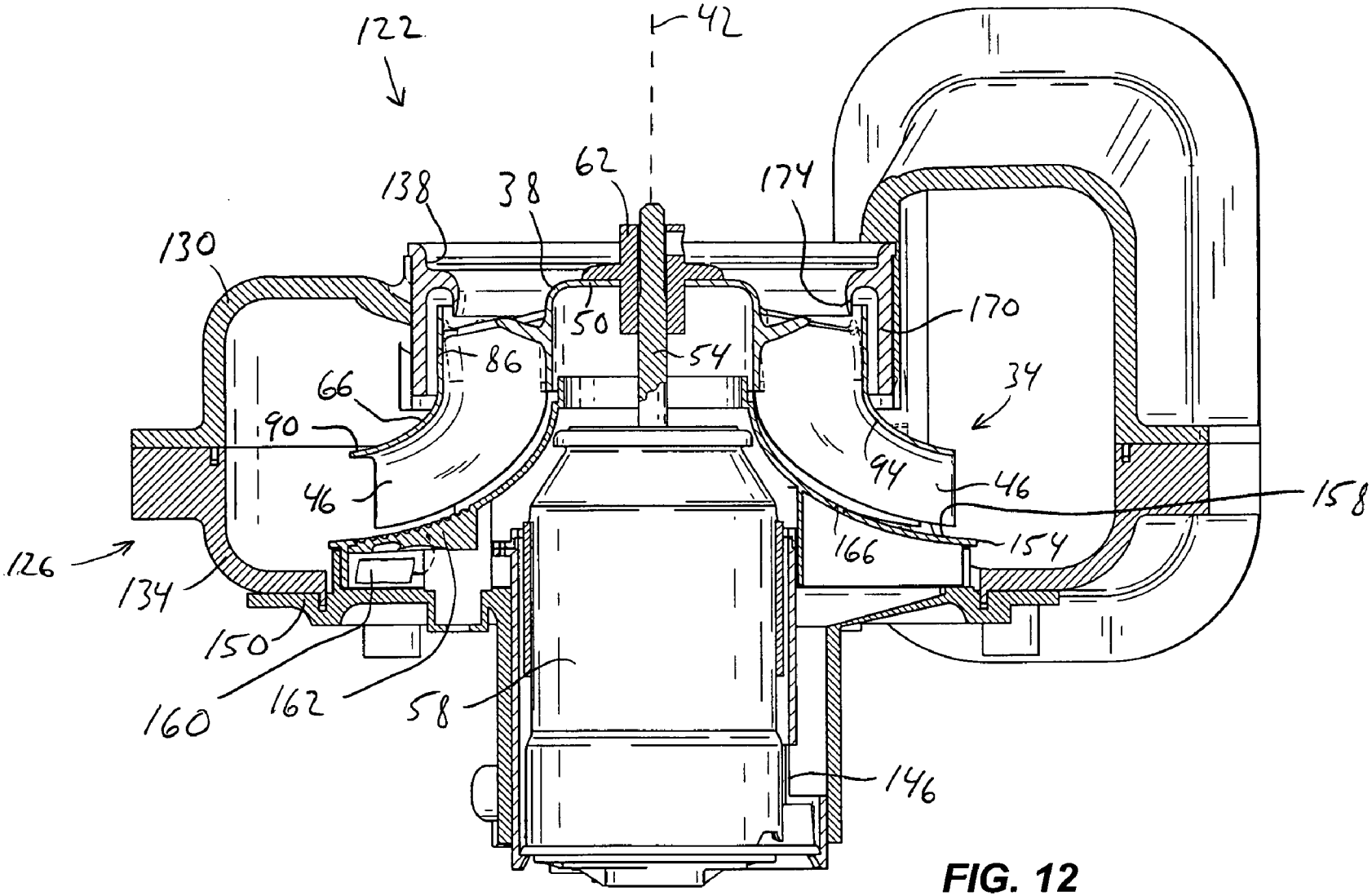
FIG. 12 is an assembled partial section view of the centrifugal blower of FIG. 10.

With reference to FIGS. 2–6, a fan 34 of the present invention is shown. The fan 34 employs, among other things, a unique blade shape. The fan 34 generally includes a hub 38 configured for rotation about a central axis 42, and a first plurality of blades 46 arranged about the central axis 42 and coupled to the hub 38 for rotation with the hub 38. The hub 38, as shown in FIGS. 2–6 and FIG. 12, utilizes a central mounting portion 50 configured to be mounted to a drive shaft 54 of a motor 58. As shown in FIG. 12, a locking member 62 may be utilized to secure the fan 34 to the drive shaft 54. Alternatively, the central mounting portion 50 may be configured in any of a number of different ways (e.g., having a bolt pattern, a key and keyway arrangement, etc.) for mounting the hub 38 to the drive shaft 54 of the motor 58. Also, the central mounting portion 50 may be integrally formed with the hub 38. However, in another construction of the fan 34, the central mounting portion 50 may comprise a metal insert that is insert-molded with the fan 34.

Figure 14:
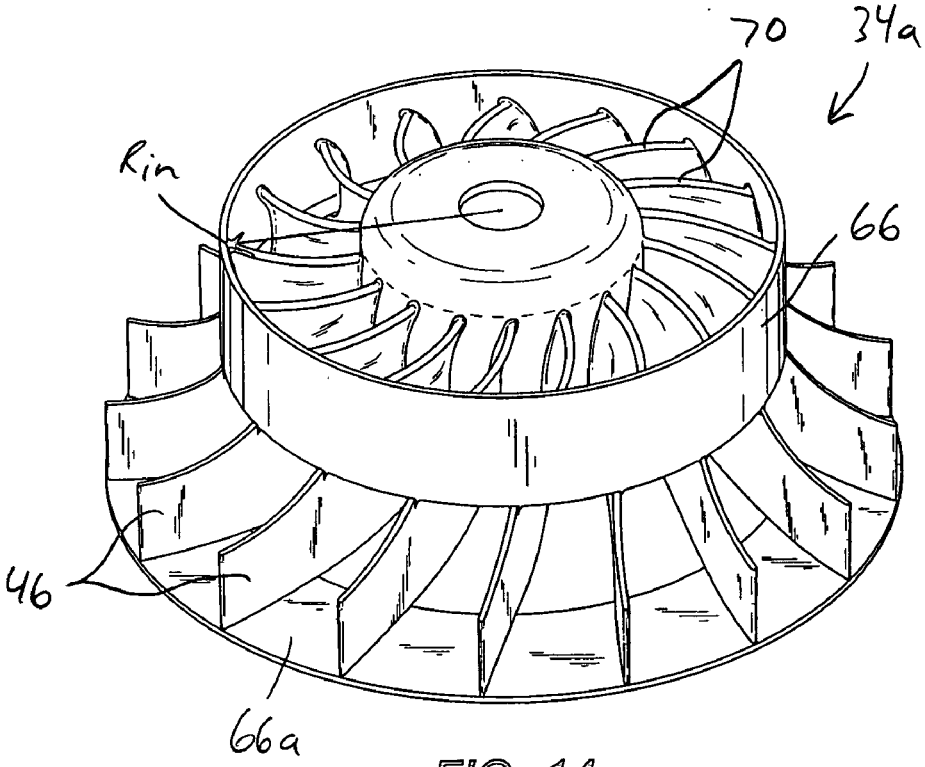
FIG. 14 is a top perspective view of another construction of a fan embodying the invention.
Figure 16:
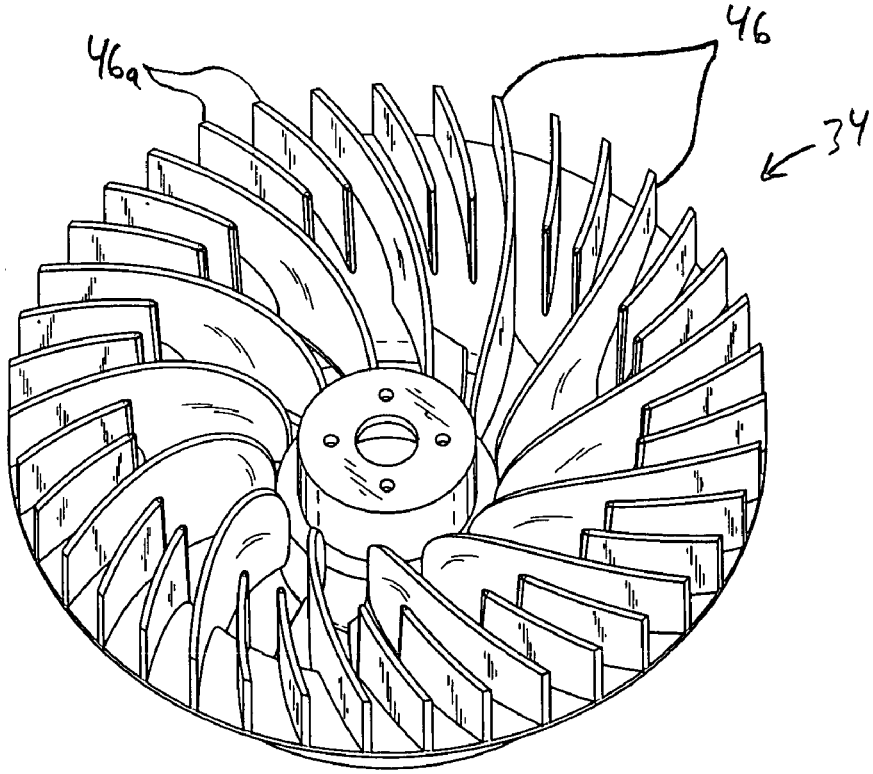
FIG. 16 is a bottom perspective view of yet another construction of a fan embodying the present invention.

With continued reference to FIGS. 2–6, the fan 34 may also include a first shroud 66 coupled for rotation with the blades 46. Additionally, the fan 34 may also include a second shroud 66*a* (see FIG. 14) coupled for rotation with the blades 46. Additionally, the fan 34 may also include a second plurality of blades 46*a*, or splitter blades (see FIG. 16), arranged about the central axis 42 and coupled to the first shroud 66 or second shroud 66*a*.

Figure 4:
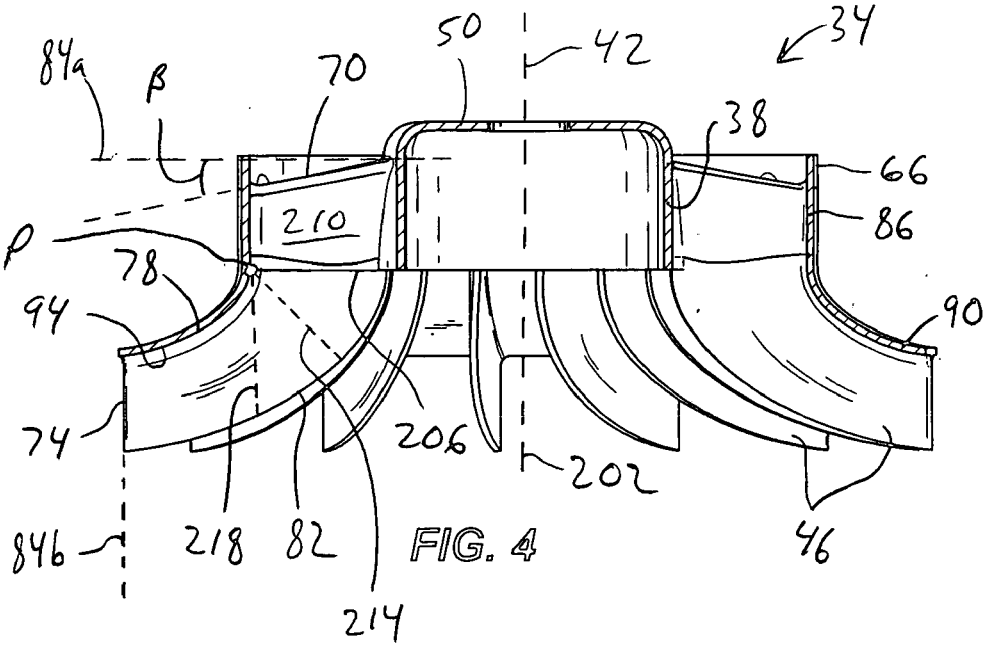
FIG. 4 is a section view of the fan of FIG. 2 along section line 4—4.
Figure 5:
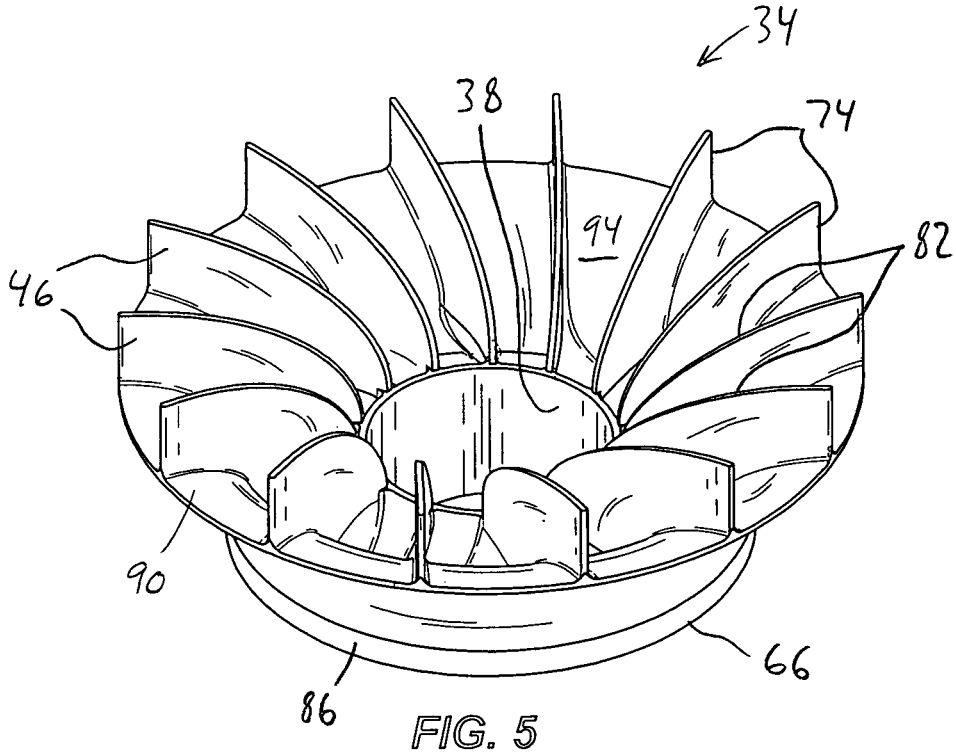
FIG. 5 is a bottom perspective view of the fan of FIG. 2.
Figure 6:
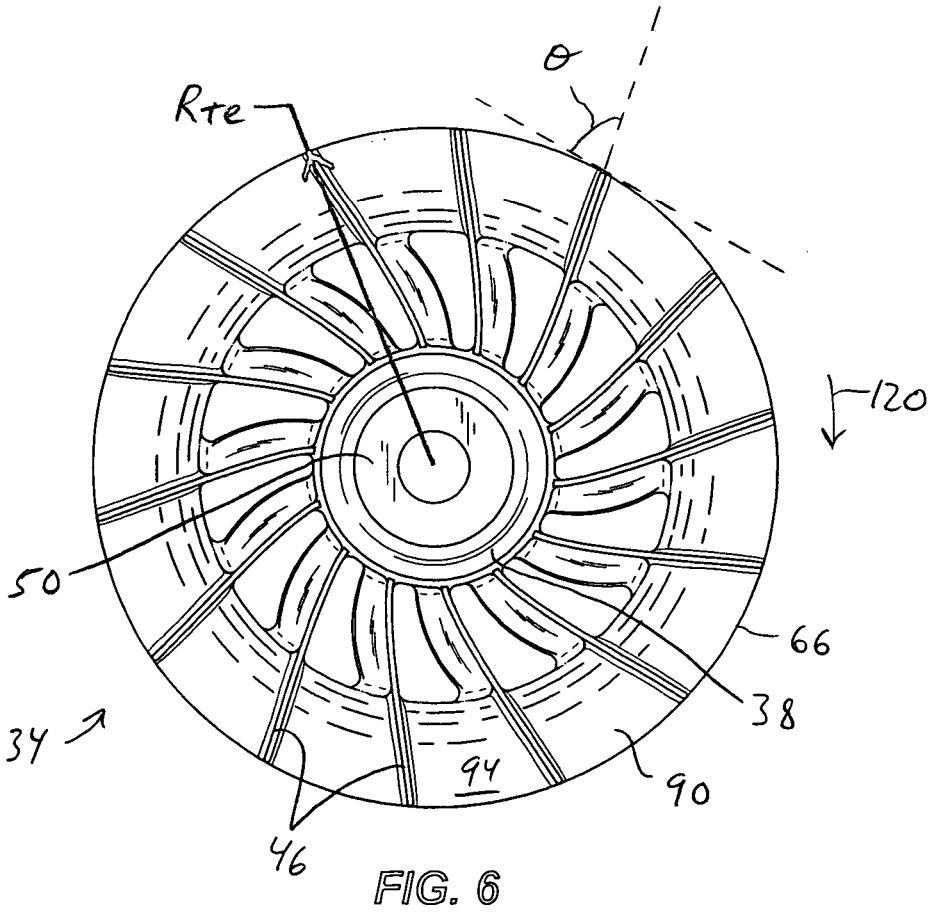
FIG. 6 is a bottom view of the fan of FIG. 2.

As shown in FIG. 4, each of the first plurality of blades 46 defines a leading edge 70, a trailing edge 74, a first side edge 78, adjacent or extending between the leading edge 70 and the trailing edge 74, and a second side edge 82, adjacent or extending between the leading edge 70 and the trailing edge 74. The leading edge 70 may be substantially perpendicular to the central axis 42, while the trailing edge 74 may be substantially parallel to the central axis 42. However, the leading edge 70 may define an angle β with a plane 84*a* normal to the central axis 42, and the trailing edge 74 may define an angle (shown as about 0 degrees in FIG. 4) with a plane 84*b* parallel to the central axis 42. In a preferred embodiment, the angle β between the leading edge 70 and the plane 84*a* may be between about 0 degrees and about 45 degrees, and the angle between the trailing edge 74 and the plane 84*b* may be between about 0 degrees and 45 degrees. In a most preferred embodiment, the angle β between the leading edge 70 and the plane 84*a* may be between about 0 degrees and about 30 degrees, and the angle between the trailing edge 74 and the plane 84*b* may be between about 0 degrees and 30 degrees. This type of leading edge 70 allows a portion of the leading edge 70 to be at a relatively small radius, resulting in lower relative flow velocities at the inner portions of the leading edge 70, and lower noise generated as a result of these lower velocities compared to the forward-curved fan 10, the two-piece backward-curved fan 300, and the one-piece backward-curved fan 400. The first side edge 78 and the second side edge 82 may be curved, such that both first and second side edges 78, 82 are swept from the leading edge 70 in a direction axially away from the leading edge 70 and generally radially outward toward the trailing edge 74.

The first shroud 66 is integral with the respective first side edges 78 of the first plurality of blades 46. As a result, the first shroud 66 generally follows the contour of the respective first side edges 78 of the first plurality of blades 46. As shown in an alternate construction of the fan 34*a* of FIG. 14, the second shroud 66*a* is fixed to the respective second side edges 82 of the first plurality of blades 46. As a result, the second shroud 66*a* generally follows the contour of the respective second side edges 82 of the first plurality of blades 46. Further, the hub 38 is integral with at least a portion of the respective second side edges 82 of the first plurality of blades 46.

Figure 3:
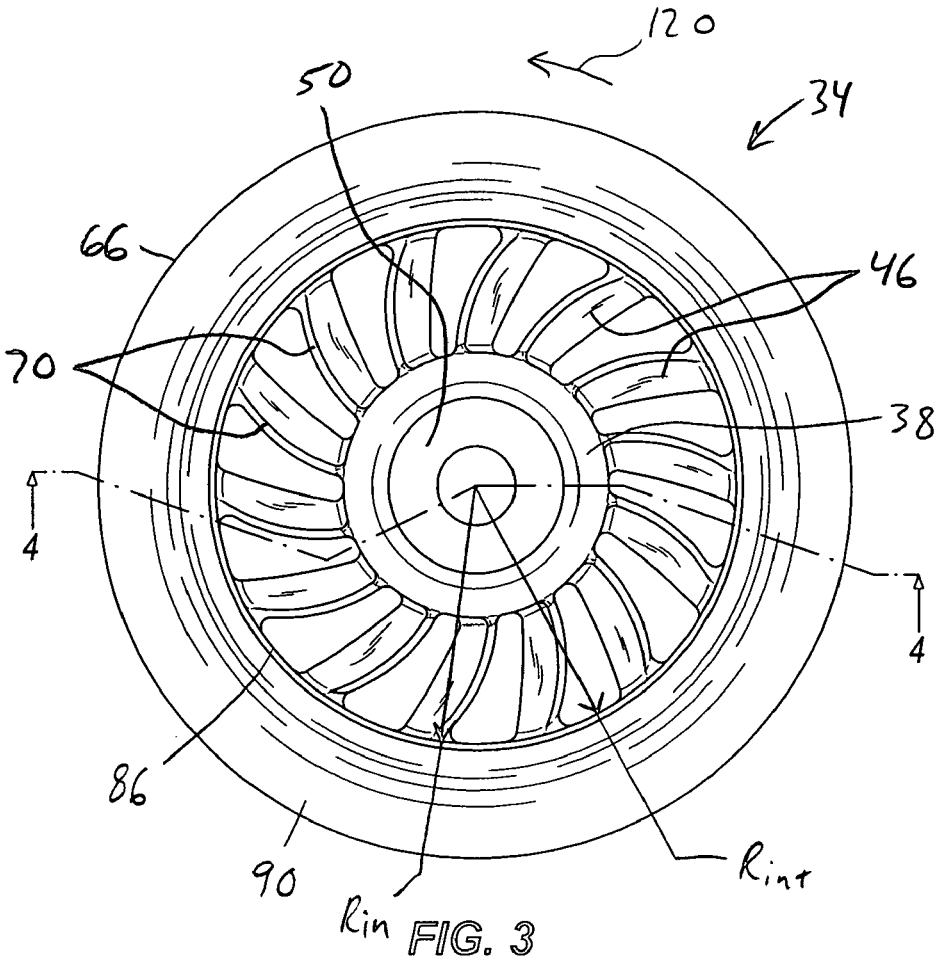
FIG. 3 is a top view of the fan of FIG. 2.

As shown in FIGS. 2–6, the blades 46, in combination with the hub 38, define an annular, axially-oriented inlet of the fan 34 defined by an inlet radius $R_{in}$ (see FIG. 3). The inlet radius $R_{in}$ of the fan 34 corresponds to the greatest radial extent of the blade leading edge 70. Also, the first shroud 66 may include a cylindrical portion 86 that defines an intermediate radius $R_{int}$, which corresponds with the innermost radius of the first shroud 66. As shown in FIG. 3, the inlet radius $R_{in}$ and the intermediate radius $R_{int}$ are substantially equal, however, different constructions of the fan 34 may include different values for the inlet radius $R_{in}$ and the intermediate radius $R_{int}$. For example, in an embodiment of the fan (not shown) only using a rotating second shroud 66*a*, the intermediate radius $R_{int}$ may be defined as the innermost radius of the rotating second shroud 66*a*. Further, in an embodiment of the fan 34*a* using both a rotating first shroud 66 and a rotating second shroud 66*a* (see FIG. 15), the intermediate radius $R_{int}$ may be defined as the innermost radius of the rotating second shroud 66*a*. The cylindrical portion 86 may also extend upstream of the intersection of the leading edges 70 and the first side edges 78 of the first plurality of blades 46.

The first shroud 66 may also include a flared bell portion 90 radially and axially extending from the cylindrical portion 86. The bell portion 90 at least partially defines a substantially annular, radially outward-oriented outlet of the fan 34. The bell portion 90, in addition to providing structural support for the blades 46, at least partially provides a guide surface 94 for guiding the airflow through the fan 34, and prevents leakage from one side of a blade to the other.

Alternatively, in another construction of the fan 34, the first shroud 66 may not extend over the full length of the first side edge 78, as a means to reduce the material required for construction of the fan.

Alternatively, in another construction of the fan 34*a* (see FIG. 14), both the first shroud 66 and the second shroud 66*a* may be incorporated together to provide further structural integrity to the fan 34*a*, and as a means to eliminate the loss in efficiency associated with the flow that travels from the pressure side of the blades 46 to the suction side. The inlet radius $R_{in}$ of the fan 34*a* corresponds to the greatest radial extent of the blade leading edge 70 (see FIGS. 14 and 15). For the fan 34*a* to be molded as a single piece, the innermost radius of the second shroud 66*a* must be larger than the inlet radius $R_{in}$ of the fan 34*a*, and larger than the outermost radius of the first shroud 66.

Figure 7A:
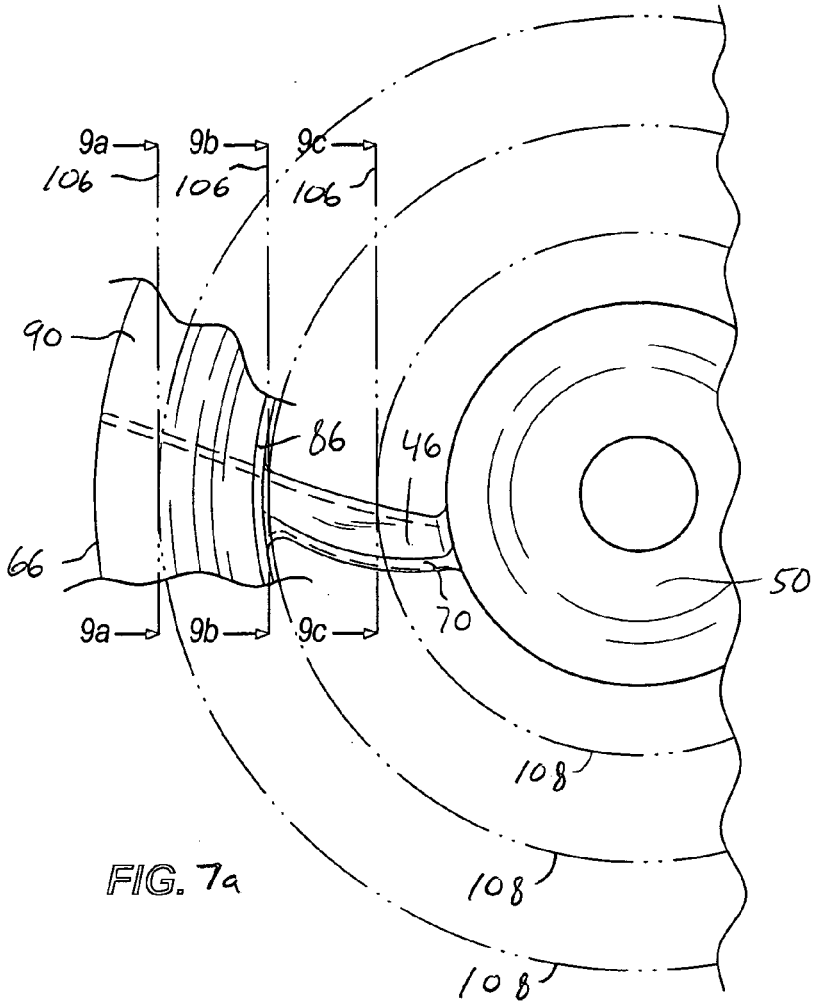
FIG. 7*a* is a partial top view of the fan of FIG. 2, illustrating a singular blade.
Figure 7B:
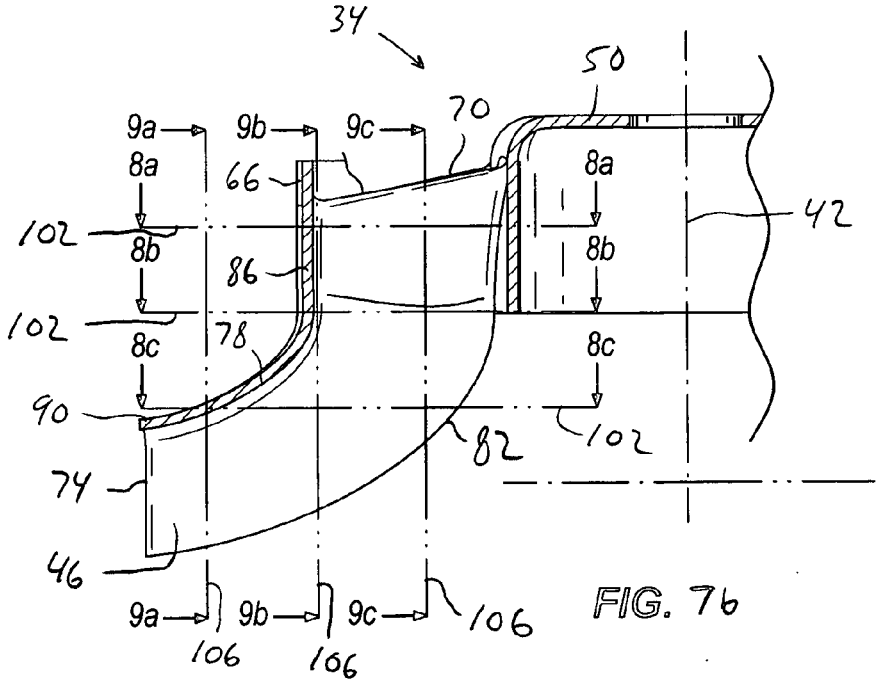
FIG. 7*b* is a partial section view of the fan of FIG. 2, illustrating a singular blade.
Figure 8A:
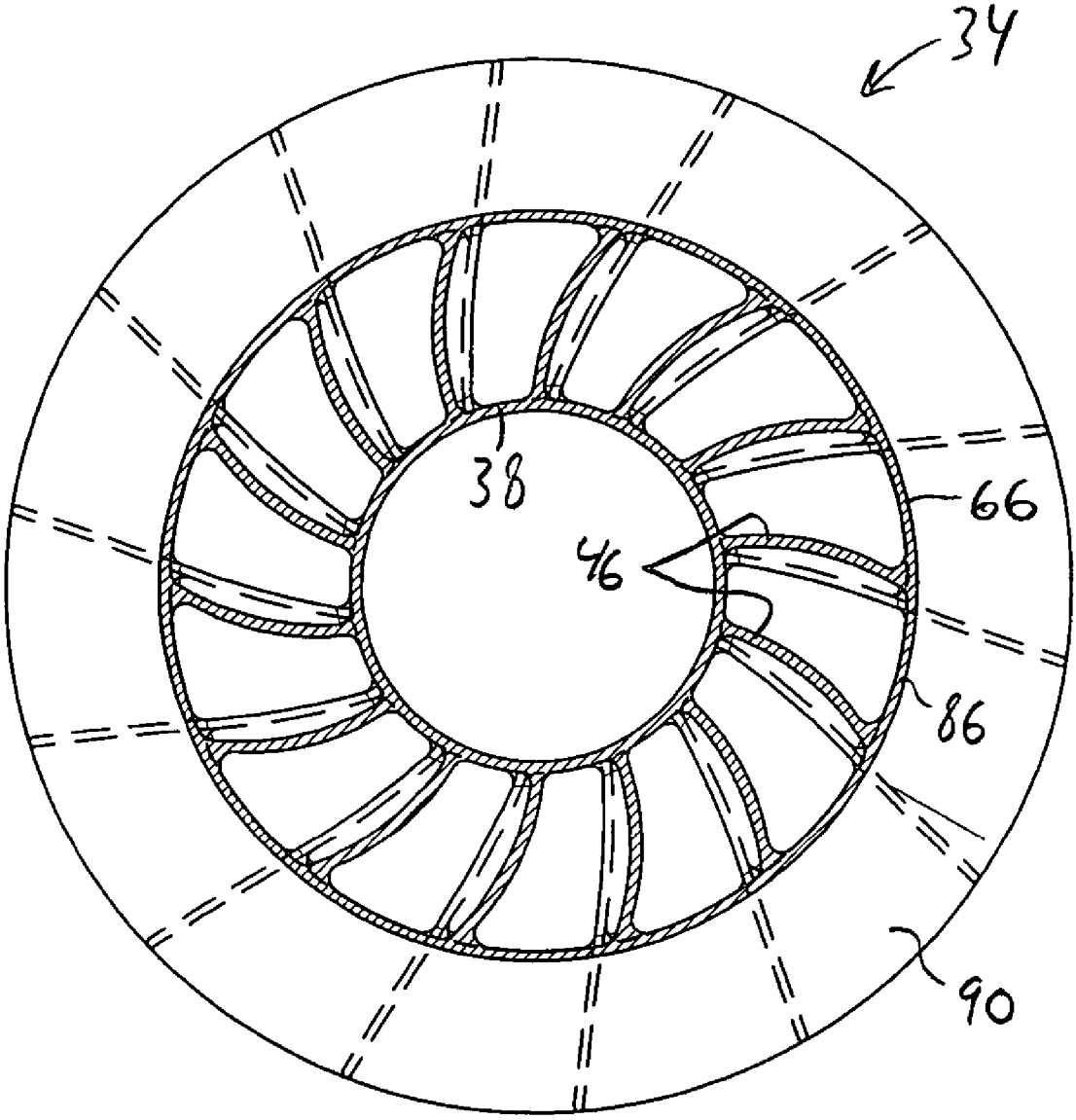
FIG. 8*a* is a section view of the fan of FIG. 7*b* along section line 8*a*—8*a*.
Figure 8B:
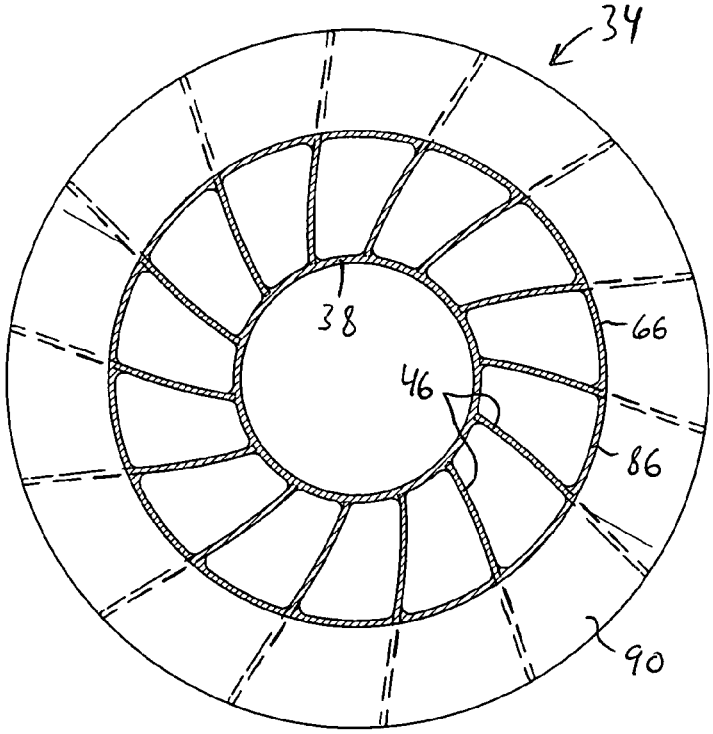
FIG. 8*b* is a section view of the fan of FIG. 7*b* along section line 8*b*—8*b*.
Figure 8C:
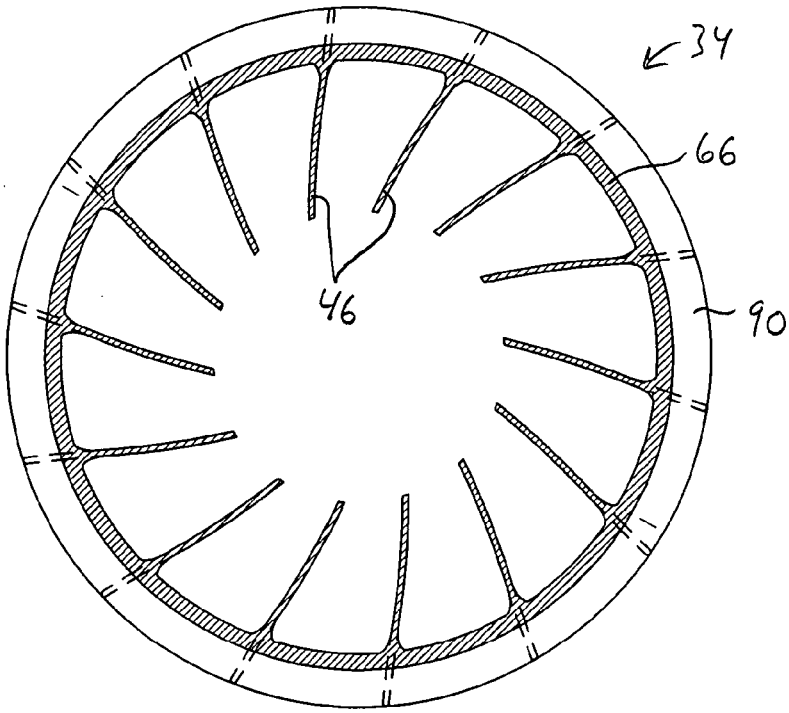
FIG. 8*c* is a section view of the fan of FIG. 7*b* along section line 8*c*—8*c*.

As shown in FIGS. 2–6, and additionally in FIGS. 7*a*–7*b*, the blades 46 each include a blade shape, a portion of which is comprised of a two-dimensional blade form, while the remaining portion is comprised of a three-dimensional blade form. In such a blade 46 having a three-dimensional blade form, the blade 46 may include a curvature in a plane 102 (see FIG. 7*b*), which extends through the blades 46 and normal to the central axis 42. FIGS. 8*a*–8*c* illustrate different cross-sectional shapes of the blades 46 at varying locations of the plane 102 along the central axis 42. The cross-sectional shapes of the blade 46 may be defined by the plane 102 at a plurality of different positions along the central axis 42.

Figure 9A:
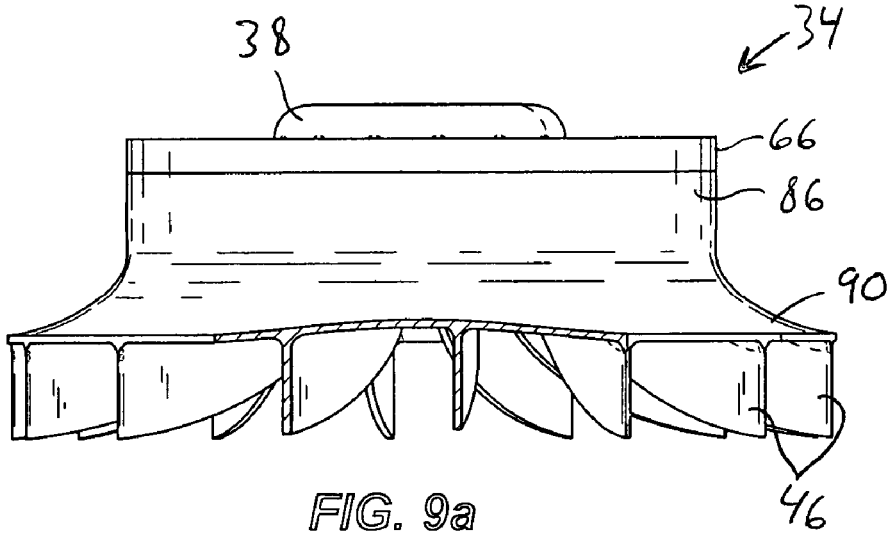
FIG. 9*a* is a section view of the fan of FIG. 7*b* along section line 9*a*—9*a*.
Figure 9B:
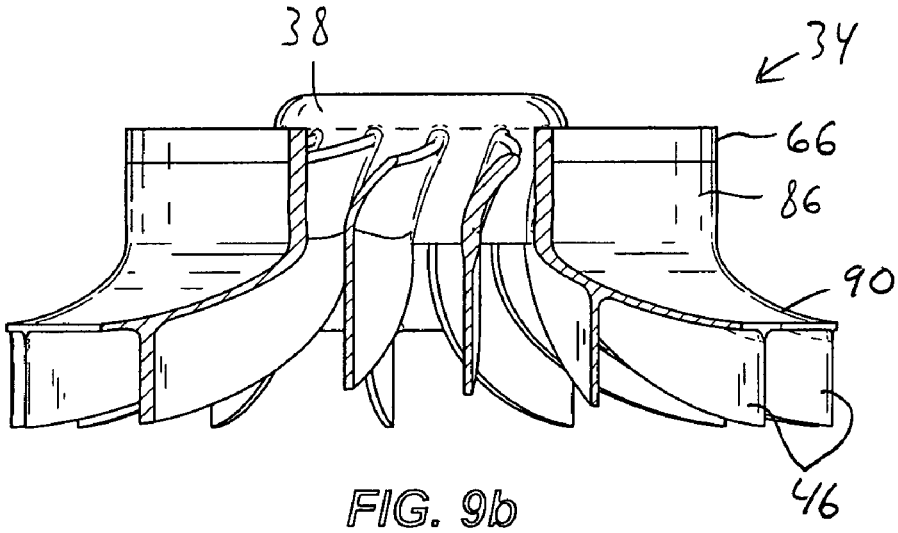
FIG. 9*b* is a section view of the fan of FIG. 7*b* along section line 9*b*—9*b*.
Figure 9C:
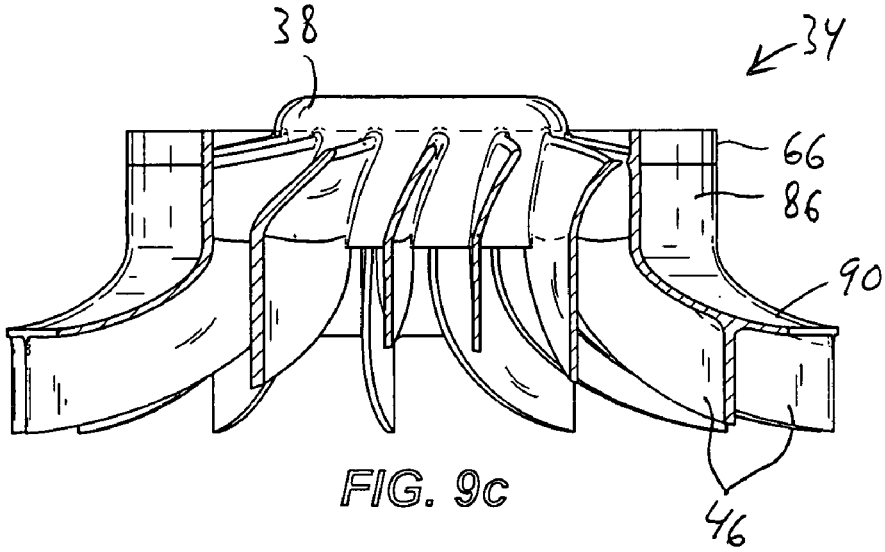
FIG. 9*c* is a section view of the fan of FIG. 7*b* along section line 9*c*—9*c*.

In addition, as shown in FIGS. 7*a* and 7*b*, the blade 46 includes a curvature in another plane 106, which extends through the blade 46 and tangent to a cylinder 108 which extends through the blade 46 and is centered along the central axis 42. FIGS. 9*a*–9*c* illustrate different cross-sectional shapes of the blades 46 at varying locations of the plane 106 corresponding with different cylinders 108 of varying diameter (shown only in the partial top view of the fan 34 in FIG. 7*a*). Each of the plurality of cross-sectional shapes radially inward of the inlet radius $R_{in}$ (see FIG. 3) includes a curvature in the plane 106. Also, for this fan 34 to be easily manufactured by a molding process with a simple two-piece mold, each of the plurality of cross-sectional shapes radially outward of the intermediate radius $R_{int}$ must not include a curvature in the plane 106.

The blades 46 define blade chords that are much larger than those utilized in conventional, forward-curved fans 10. The blade chord is defined as the straight line distance from a point at the intersection of the blade leading edge 70 and the second side edge 82 to a point at the intersection of the blade trailing edge 74 and the second side edge 82. Maximum camber is defined as the maximum perpendicular distance between the blade chord and the blade surface. The large blade chords result in a much lower maximum camber to chord ratio for the blade 46, compared to the forward-curved fan 10. In turn, this permits the airflow through the fan 34 to remain substantially attached to the blade surfaces over a significant portion of the blade chord, which may yield an increase in efficiency of the fan 34.

The blades 46 may be shaped such that they may be described by any of a number of different camber values and/or chord values. In one construction of the blade 46, for example, a chord length measured between the leading and trailing edges 70, 74 of the blade 46 and at the second side edge 82 of the blade 46 may be at least about 50% of an outermost radius of the fan (e.g., trailing edge radius $R_{te}$, see FIG. 6). However, in another construction of the blade 46, a chord length measured between the leading and trailing edges 70, 74 of the blade 46 and at the second side edge 82 of the blade 46 may be at least about 75% of an outermost radius of the fan 34. In yet another construction of the blade 46, a chord length measured between the leading and trailing edges 70, 74 of the blade 46 and at the second side edge 82 of the blade 46 may be at least about 85% of an outermost radius of the fan 34.

The blades 46 may also be shaped such that they may be described by any of a number of different maximum camber to chord ratios. In one construction of the blade 46, for example, the magnitude of the maximum camber to chord ratio over the surface of the blade 46 may be no more than about 10%. However, in another construction of the blade 46, the magnitude of the maximum camber to chord ratio over the surface of the blade 46 may be no more than about 7.5% of the outermost radius of the fan 34. In yet another construction of the blade 46, the magnitude of the maximum camber to chord ratio over the surface of the blade 46 may be no more than about 5% of the outermost radius of the fan 34.

In addition, the blades 46 may be spaced on the fan 34 such that they may be described by any of a number of different blade solidity values. Blade solidity is defined as the ratio of chord length to the spacing between adjacent blades 46 at the blade trailing edge 74. In one construction of the fan 34, for example, the blade solidity may be at least about 2.0. However, in another construction of the fan 34, the blade solidity may be at least about 2.25. In yet another construction of the fan 34, the blade solidity may be at least about 2.5.

As shown in FIGS. 3 and 7*a*, the blades 46 may also be skewed at their leading edges 70. Skew at a point on the leading edge 70 of the blade 46 is defined as the extent to which the slope of the leading edge varies from a plane containing the central axis 42 and passing through that point. Skewing the leading edges 70 of the blades 46 may reduce tonal and overall noise levels by allowing only a portion of the leading edge 70 of the blade 46 to encounter an upstream disturbance in the airflow at any one time. The leading edges 70 of the blades 46 may be skewed either forward, backward, or forward over one portion of the leading edge 70 and backward over another portion of the leading edge 70, with reference to the direction of rotation (indicated by arrow 120) of the fan 34. Forward skewed leading edges 70 are sloped in the direction of fan rotation, with portions at an outer radius forward of portions at an inner radius. Backward skewed leading edges 70 are sloped opposite the direction of fan rotation, with portions at an outer radius rearward of portions at an inner radius. Leading edge skew can be very effective in reducing noise. Blade skew is not feasible when the blade leading edges are substantially parallel to the central axis 42, as with the forward-curved fan 10, the two-piece backward-curved fan 300, and the one-piece backward-curved fan 400.

As shown in FIGS. 4 and 7*b*, the blades 46 may also be raked at their leading edges 70. With reference to the orientation of the fan 34 in FIG. 4, rake at a point on the leading edge 70 of the blade 46 is defined as the extent to which the slope of the leading edge 70 varies from a plane normal to the central axis 42 and passing through that point. Raking the leading edges 70 of the blades 46 may help reduce tonal and overall noise levels for the same reasons as discussed above relating to leading edge skew. Leading edge rake also allows the blade tips to be positioned further away from any upstream structures that may be causing a flow disturbance that could lead to tonal noise. The leading edges 70 of the blades 46 may be raked either forward, rearward, or forward over one portion of the leading edge 70 and backward over another portion of the leading edge 70. Blades 46 having forward rake are shaped such that their leading edges 70 are sloped forward axially, in the upstream direction as radius increases, while blades 46 having rearward rake are sloped such that their leading edges 70 are rearward axially, in the downstream direction as radius increases.

In one construction of the fan 34, the leading edges 70 of the blades 46 may be raked without being skewed. Likewise, in another construction of the fan 34, the leading edges 70 of the blades 46 may be skewed without being raked. Further, in yet another construction of the fan 34, the leading edges 70 of the blades 46 may be skewed and raked.

It should also be noted that the fan 34 may be configured with either backward or forward-curved blades 46. A backward-curved blade 46, for example, defines a trailing edge angle θ of less than 90 degrees (see FIG. 6), with respect to the direction of rotation (indicated by arrow 120) of the fan 34, while a forward-curved blade 46 defines a trailing edge angle θ in excess of 90 degrees. The trailing edge angle θ is the angle the blade 46 makes with a tangent to the fan 34 at the blade trailing edge 74. The illustrated fan 34 is configured with backward-curved blades 46.

The blades 46 may also be shaped such that they define any of a number of different trailing edge angles θ. In one embodiment of the fan 34, the trailing edge angle θ is between about 50 degrees and about 140 degrees. In a preferred embodiment of the fan, the trailing edge angle θ is between about 70 degrees and about 120 degrees. In a most preferred embodiment of the fan 34, the trailing edge angle θ is between about 80 degrees and 110 degrees.

Figure 10:
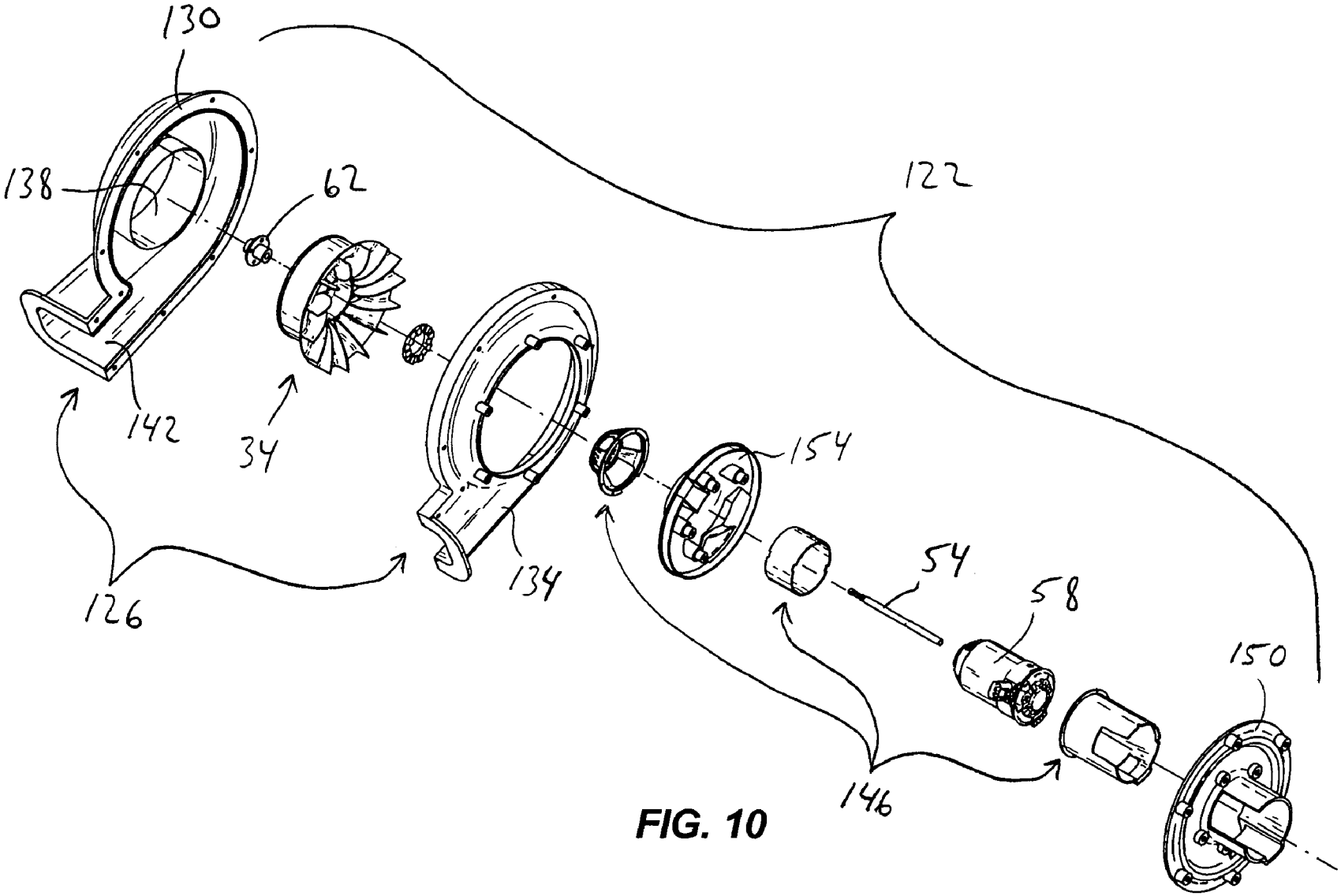
FIG. 10 is an exploded perspective view of a centrifugal blower including the fan of FIG. 2.

With reference to FIG. 10, a centrifugal blower 122, including the fan 34, is shown exploded into its individual components. The fan 34 is substantially enclosed within a blower housing 126, which, as shown in FIG. 10, is comprised of respective first and second shells 130, 134. The shells 130, 134 each define a scroll shape, as is known in the art, such that the inlet of the fan 34 is positioned in an inlet opening 138 of the first shell 130 and is in communication therewith, and the resulting airflow generated by the fan 34 is discharged from the outlet of the fan 34 through a scroll outlet 142 defined by the first and second shells 130, 134. The blower housing 126 may be made from a plastic material and manufactured using a molding process (e.g., injection molding).

With reference to FIG. 10, a motor housing 146 contains the motor 58, and the motor housing 146 is coupled to a flange 150 to be coupled to the second shell 134 of the blower housing 126. To decrease the amount of vibration transmitted to the blower housing 126 from the motor 58, the motor 58 may be isolation-mounted using any of a number of known methods (e.g., rubber isolation mounts). In one construction of the centrifugal blower 122, the motor housing 146 and flange 150 may be integral components, while in another construction of the centrifugal blower 122, the motor housing 146 and flange 150 may be separate and distinct components that are connected by any of a number of different ways (e.g., fastening, welding, pressing, bonding, etc.). Further, in yet other constructions of the centrifugal blower 122, the motor housing 146, flange 150, second shell 134, and any combinations thereof may be integral components.

A second non-rotating shroud 154, is positioned adjacent to the second shell 134 and coaxial with the fan 34 and fixed against rotation with the fan 34. In one construction of the centrifugal blower 122, the second non-rotating shroud 154 and second shell 134 may be integral components, while in another construction of the centrifugal blower 122, the second non-rotating shroud 154 and second shell 134 may be separate and distinct components that are connected by any of a number of different ways (e.g., fastening, welding, pressing, bonding, etc.). Further, in yet other constructions of the centrifugal blower 122, the motor housing 146, flange 150, second non-rotating shroud 154, second shell 134, and any combinations thereof may be integral components.

The second non-rotating shroud 154 includes a bell-shaped second surface 158 (see also FIG. 11) in closely spaced, facing relationship with the respective second side edges 82 of the plurality of blades 46. As shown in FIG. 12, the second non-rotating shroud 154 follows the contour of the respective second side edges 82 of the plurality of blades 46 such that a gap or clearance exists between the respective second side edges 82 of the plurality of blades 46 and the second surface 158. Ideally, the clearance between the respective second side edges 82 of the plurality of blades 46 and the second surface 158 should be as small as manufacturing tolerances allow to substantially prevent "leakage" of the airflow across the blades 46.

In one embodiment of the centrifugal blower 122, the clearance between the respective second side edges 82 of the plurality of blades 46 and the second surface 158 may be less than about 6% of an outermost radius of the fan 34. In a preferred embodiment of the centrifugal blower 122, the clearance between the respective second side edges 82 of the plurality of blades 46 and the second surface 158 may be less than about 4% of an outermost radius of the fan 34.

The second surface 158 is configured to act as a guide surface to the airflow passing through the fan 34. More particularly, the first shroud 66 and the second surface 158 at least partially define therebetween a bell-shaped air passageway between the inlet and outlet of the fan 34. In combination with the previously-discussed geometry of the blades 46, the second surface 158 provides the incoming airflow with a smooth and gradual transition from an axial direction to a radial direction. Providing such a smooth and gradual transition of the airflow may yield an increase in efficiency of the fan 34. In addition, the close proximity of the second surface 158 with the respective second side edges 82 of the plurality of blades 46 increases the attachment of the airflow to the blades 46 and decreases the amount of turbulence around the blades 46, which may yield an increase in efficiency of the fan 34. In the illustrated construction, the second non-rotating shroud 154 extends radially outwardly and terminates at a radius greater than the trailing edge radius $R_{te}$ of the fan 34 (see FIG. 6). However, the second non-rotating shroud 154 may also be configured to extend radially outwardly and terminate at a radius either substantially equal to or less than the trailing edge radius $R_{te}$.

Likewise, the bell portion 90 of the first shroud 66 may be configured to extend radially outwardly and terminate at a radius either greater than, less than, or substantially equal to the trailing edge radius $R_{te}$. In constructions of the centrifugal blower 122*a* utilizing the fan 34*a* of FIG. 14, in which the bell portion 90 of the upper shroud 66 terminates at a radius less than the trailing edge radius $R_{te}$ or is even nonexistent, the "missing portion" of the upper shroud 66 up to the trailing edge radius $R_{te}$ may or may not be replaced by a first non-rotating shroud 154*a* (see FIG. 15). The first non-rotating shroud 154*a* may be positioned adjacent to the first shell 130 and coaxial with the fan 34*a*. In one construction of the centrifugal blower 122*a*, the first non-rotating shroud 154*a* and the first shell 130 may be integral components, while in another construction of the centrifugal blower 122*a*, the first non-rotating shroud 154*a* and first shell 130 may be separate and distinct components that are connected by any of a number of different ways (e.g., fastening, welding, pressing, bonding, etc.). Alternatively, in some constructions of the fan 34*a*, the bell portion 90 of the first rotating shroud 66 may be omitted entirely to decrease the amount of material used in manufacturing the fan 34*a*.

Figure 15:
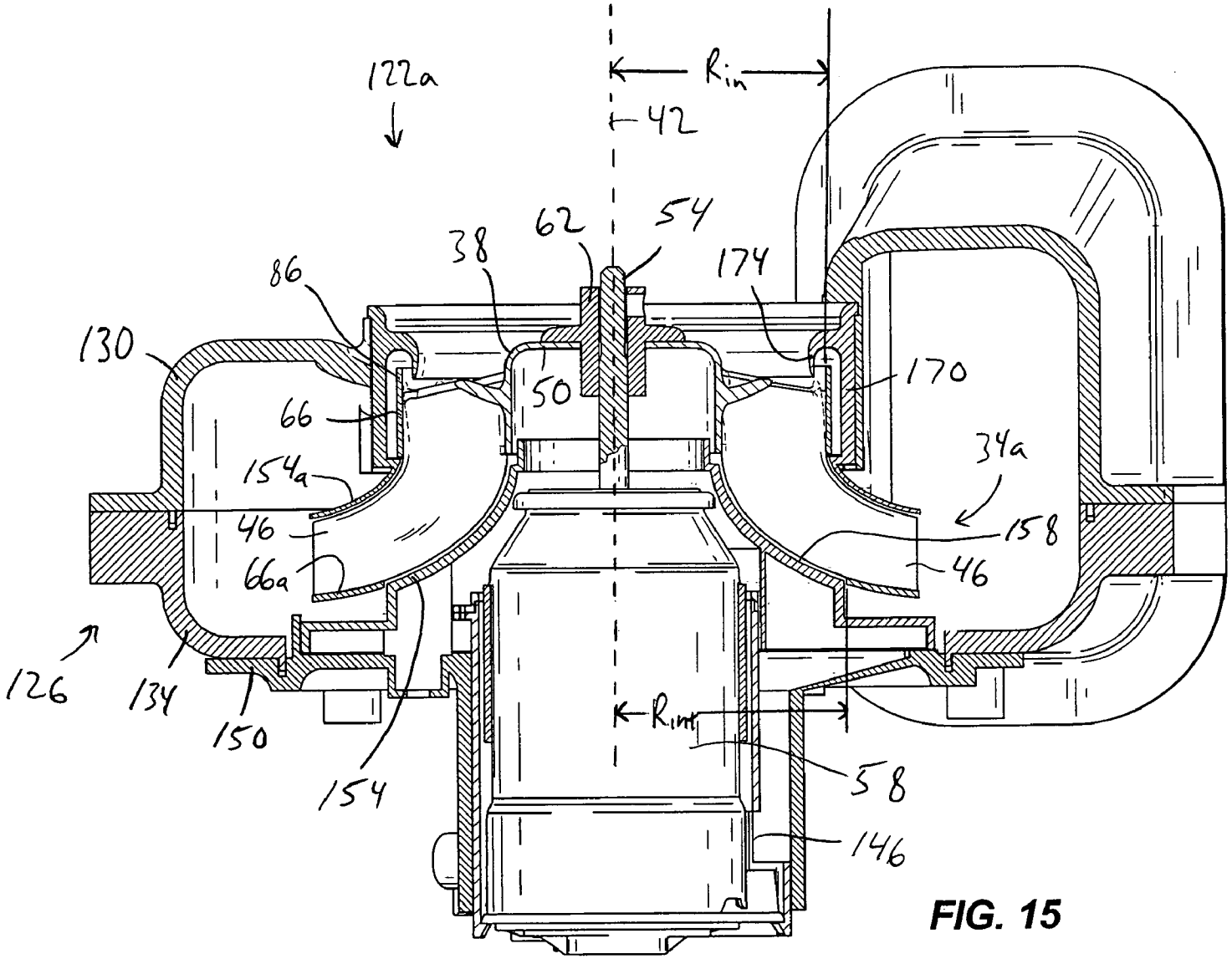
FIG. 15 is an assembled partial section view of a centrifugal blower including the fan of FIG. 14.

Additionally, as shown in FIG. 15, a portion of the second non-rotating shroud 154 may be configured to extend radially outwardly and terminate at a radius either greater than, less than, or substantially equal to the trailing edge radius $R_{te}$. In constructions of the centrifugal blower 122*a* in which the second non-rotating shroud 154 terminates at a radius less than the trailing edge radius $R_{te}$, the "missing portion" of the second non-rotating shroud 154 up to the trailing edge radius $R_{te}$ may or may not be replaced by the second rotating shroud 66*a*. The second rotating shroud 66*a* may be incorporated into the fan 34*a* as discussed above.

It should be known that a centrifugal blower, including a first rotating shroud 66, a second rotating shroud 66*a*, a first non-rotating shroud 154*a*, a second non-rotating shroud 154, and any combination thereof is also contemplated in the present invention.

Figure 18:
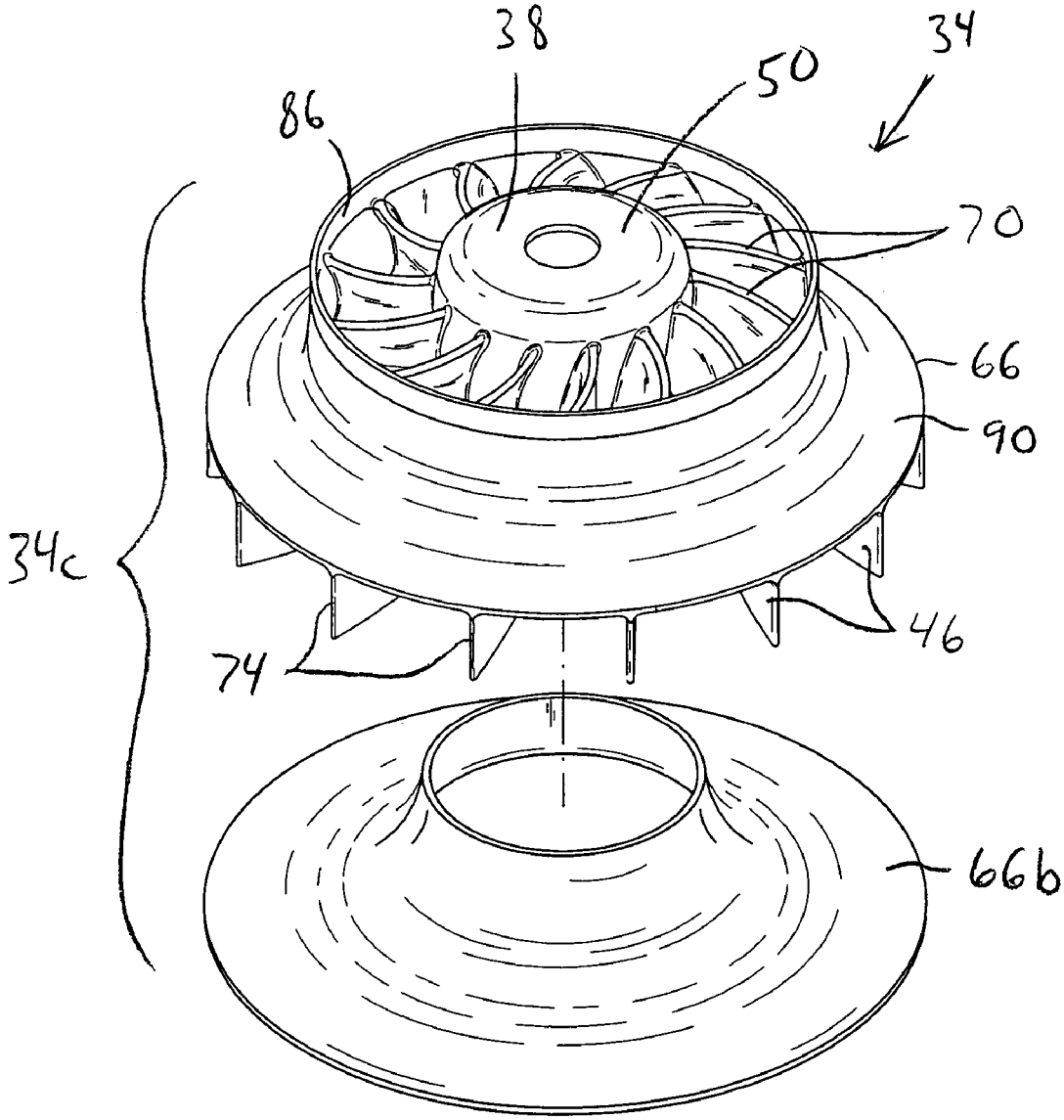
FIG. 18 is a top perspective view of a two-piece fan incorporating the fan of FIG. 2 and a lower rotating shroud.

In addition, an alternate two-piece construction of the fan 34*c* is illustrated in FIG. 18. The fan 34*c* may incorporate the fan 34 of FIGS. 2–6 with a separate lower or second shroud 66*b*. The fan 34 may be formed as one piece as discussed above, and the second shroud 66*b* may be affixed to the fan 34 using any of a number of different ways (e.g., fastening, welding, pressing, bonding, snap-fitting, etc.).

Figure 13:
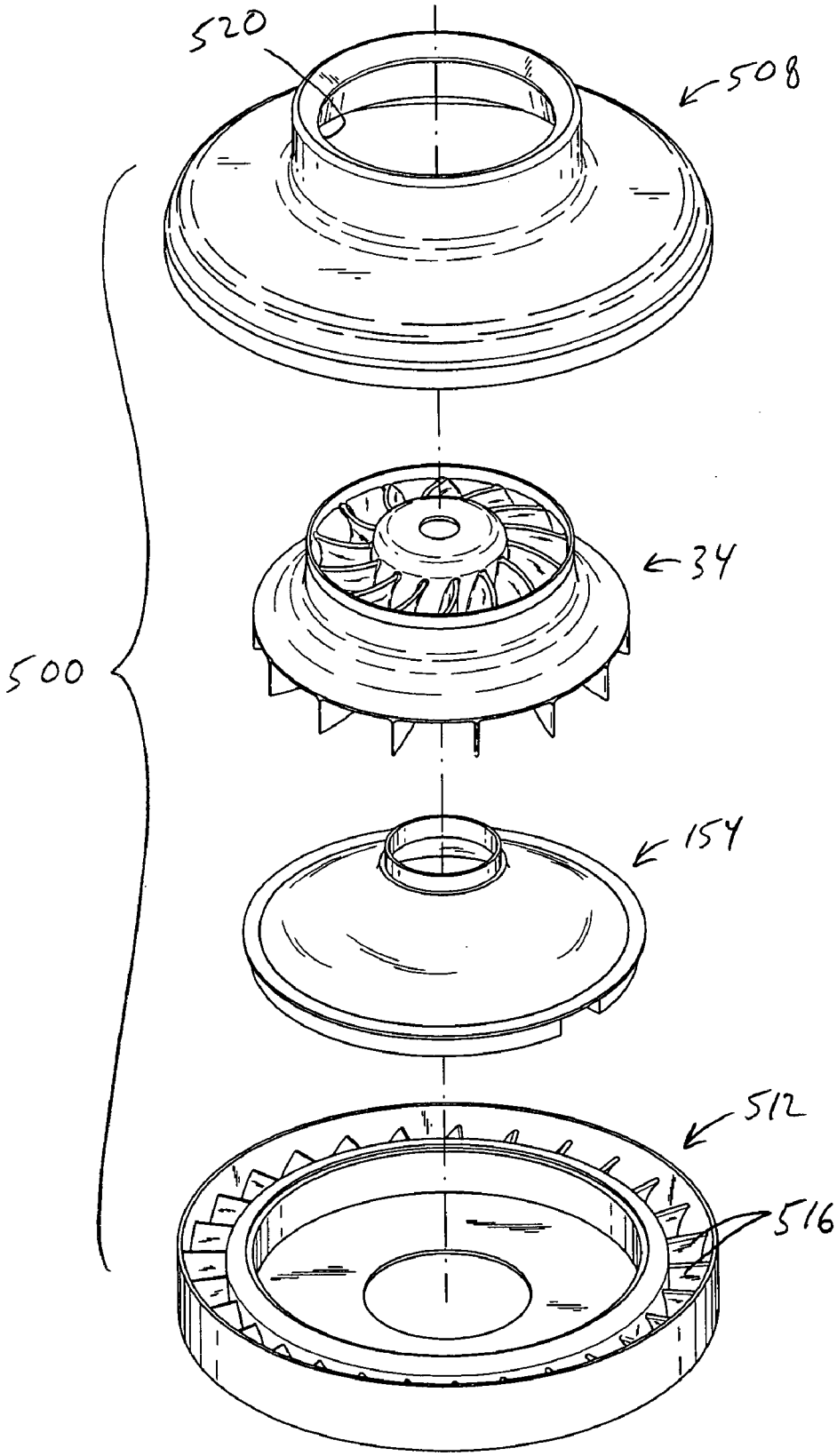
FIG. 13 is an exploded perspective view of another construction of a centrifugal blower including the fan of FIG. 2.

Alternatively, with reference to FIG. 13, another construction of the centrifugal blower 500, including the fan 34 and second non-rotating shroud 154, is shown exploded into its individual components. The fan 34 is substantially enclosed within a blower housing, which, as shown in FIG. 13, is comprised of an outer shroud 508 and an axial stator set 512 with several axial stator blades 516. The outer shroud 508 and axial stator set 512 define a shape such that the inlet of the fan 34 is positioned at an inlet opening 520 of the outer shroud 508 and is in communication therewith, and the resulting airflow generated by the fan 34 is discharged from the outlet of the fan 34 through the axial stator set 512. The blower housing 504 may be made from a plastic material and manufactured using a molding process (e.g., injection molding).

Figure 11:
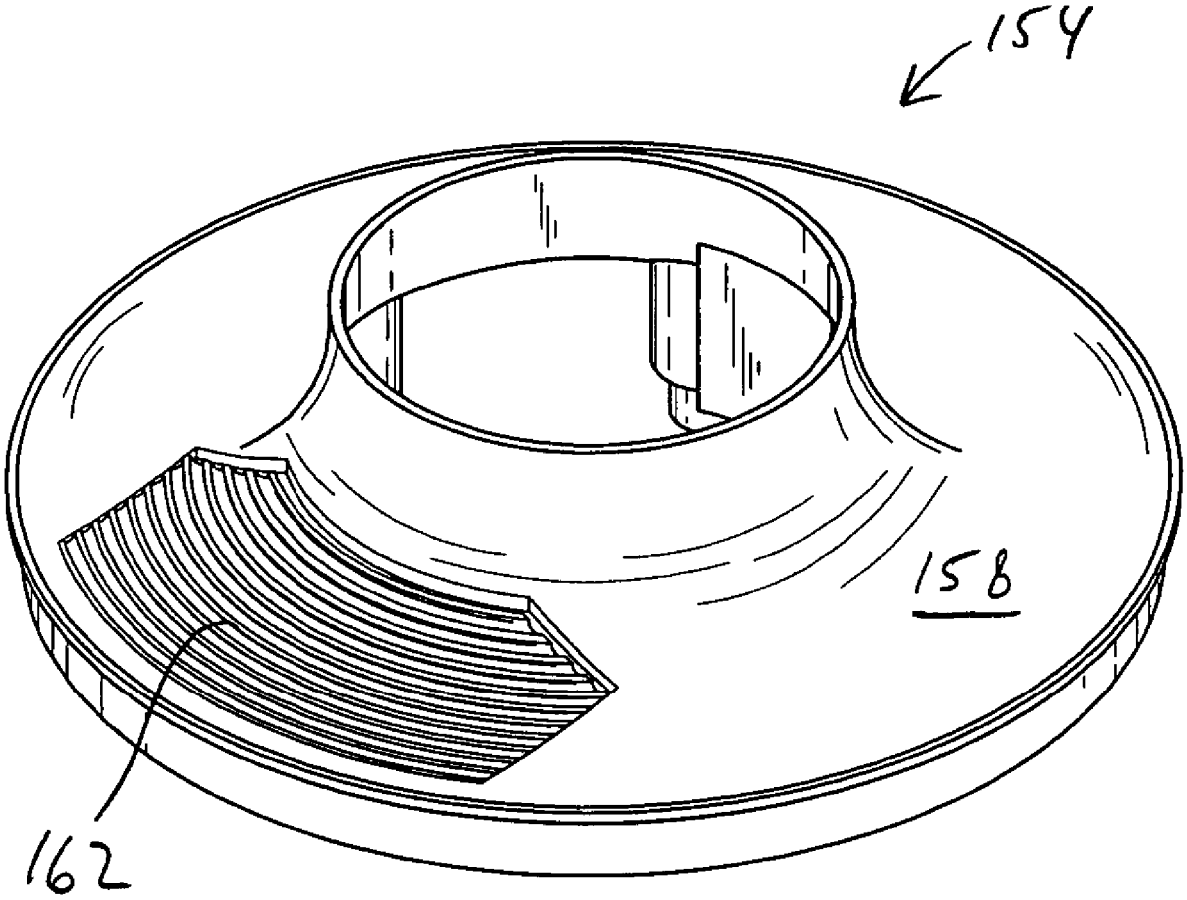
FIG. 11 is a top perspective view of a lower shroud of the centrifugal blower of FIG. 10.

Most centrifugal blowers are required to operate at several speeds. Such speed control may be achieved in different ways by using electrical components 160 like, for example, resistors or transistors, that may be operatively connected with the motor 58. These electrical components 160 should be cooled to ensure continued operation. As shown in FIGS. 11 and 12, the centrifugal blower 122 includes a heat sink 162 positioned in the second non-rotating shroud 154 and thermally coupled with the electrical components 160 such that the heat sink 162 receives a portion of the airflow generated by the fan 34 to dissipate the heat generated by the electrical components 160. Although the electrical components are schematically illustrated in FIG. 12, any of a number of different methods and/or structure may be utilized to thermally couple the electrical components 160 and the heat sink 162.

In one construction of the centrifugal blower 122, the heat sink 162 may be flat. However, in another construction of the centrifugal blower 122, the heat sink 162 may be shaped to follow the contour of the bell-shaped upper surface 158 of the second non-rotating shroud 154 and/or the respective second side edges 82 of the fan blades 46. Alternatively, the heat sink 162 may also utilize a ribbed or textured surface to increase the surface area of the heat sink 162 for more effective heat transfer.

In one construction of the centrifugal blower 122, the heat sink 162 may be located in close proximity to the fan blades 46 to directly receive a portion of the high velocity and turbulent airflow generated by the rotation of the fan 34. In such a construction, the heat sink 162 may be embedded in the second non-rotating shroud 154 such that portions of the heat sink 162 are flush with the upper surface 158 of the second non-rotating shroud 154, and that the heat sink 162 is in facing relationship with the respective second side edges 82 of the plurality of blades 46 to receive the airflow from the fan 34.

In one construction of the centrifugal blower 122, the heat sink 162 may be coupled to the second non-rotating shroud 154 such that ribs formed on the heat sink 162 are positionable flush with the upper surface 158 of the second non-rotating shroud 154. The heat sink 162 may be coupled to the second non-rotating shroud 154 by any of a number of different methods, including, among others, fastening, snap-fitting, press-fitting, and bonding. Alternatively, in another construction of the centrifugal blower 122, the heat sink 162 may be insert-molded with the second non-rotating shroud 154, the motor housing 146, flange 150, second shell 134, and any combinations thereof.

Alternatively, in another construction of the centrifugal blower 122, the heat sink 162 may be positioned in the second non-rotating shroud 154 below the upper surface 158, and one or more apertures 166 may be formed in the wall in facing relationship with the respective second side edges 82 of the plurality of blades 46, such that at least a portion of the airflow generated by the fan 34 passes through the one or more apertures 166 to reach the heat sink 162 for cooling. Alternatively, one or more apertures (not shown) may be formed in a side wall of the second non-rotating shroud 154, such that at least a portion of the airflow generated by fan 34, as the airflow is moving throughout the scroll-shaped housing 126, passes through the one or more apertures in the side wall to reach the heat sink 162 for cooling.

One or more cooling passages (not shown) may be formed in the second non-rotating shroud 154 and/or the motor housing 146 to provide a cooling airflow for the motor 58. Such cooling passages may be separate from or the same as cooling passages formed in the second non-rotating shroud 154 to cool the heat sink 162.

As shown in FIG. 12, the first shell 130 includes a first ring 170 and a second ring 174 positioned around the inlet opening 138. The second ring 174 is coaxial with the first ring 170 and spaced radially inwardly of the first ring 170. The first and second rings 170, 174 are positioned coaxial with the hub 38 and the cylindrical portion 86 of the upper shroud 66. The first and second rings 170, 174 may axially overlap, or extend past the distal end of the cylindrical portion 86. The distal ends of the first and second rings 170, 174 may be substantially straight, curved radially outwardly, or curved radially inwardly.

The combination of the first and second rings 170, 174 and the cylindrical portion 86 of the upper shroud 66 defines a labyrinth, or a tortuous passageway, between the inlet of the fan 34 and the outlet of the fan 34. Alternatively, an additional ring (not shown) may be fixed to the upper shroud coaxial with the cylindrical portion 86 to axially overlap the first ring 170 and extend the overall length of the tortuous passageway. The labyrinth or tortuous passageway increases the resistance to recirculation of the airflow from the outlet of the fan 34 back into the inlet of the fan 34. Such recirculation may cause turbulence at the inlet of the fan 34. Thus, decreasing the recirculation of airflow in the blower housing 126 may yield an increase in efficiency of the fan 34.

Figure 17:
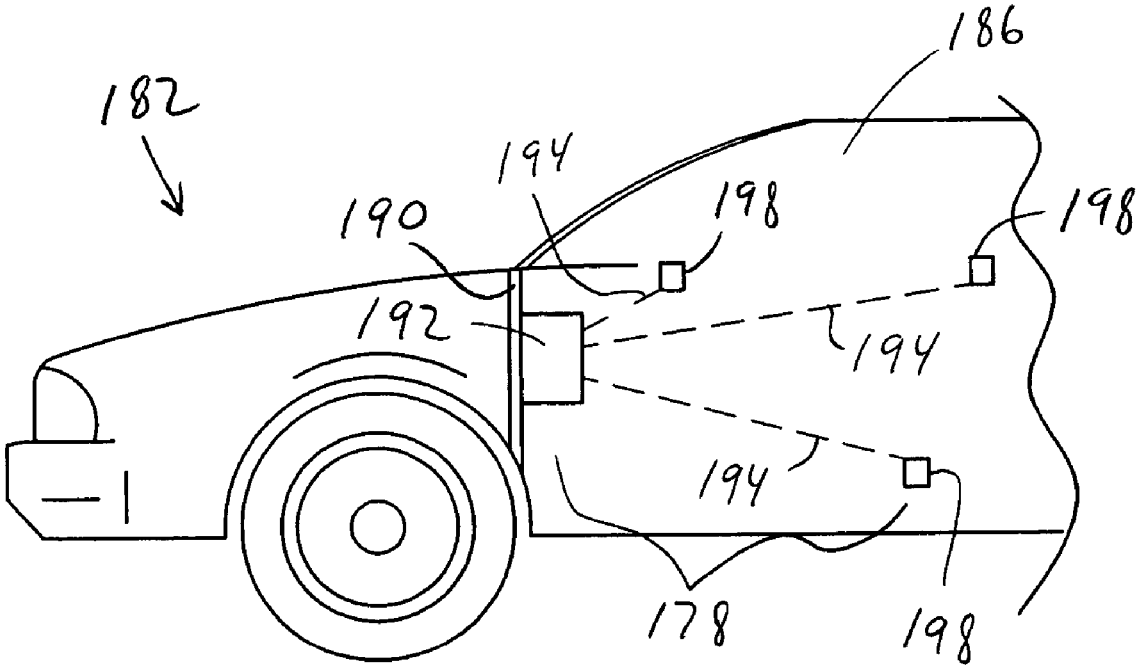
FIG. 17 is a schematic view of an automotive climate control system incorporated into an automobile.

Any of the centrifugal blowers 122, 122*a*, 500 may be adapted for use in an automotive climate control system 178, such as, for example, a heating, ventilating, and air-conditioning ("HVAC") system. Such a climate control system 178 is schematically illustrated in FIG. 17. An automobile 182 is shown generally including an engine compartment (not shown) and a passenger compartment 186 separated by a firewall 190. The climate control system 178 may include a main housing 192 enclosing one or more heat exchangers (not shown) and various ducting upstream and downstream of the heat exchangers. The main housing 192 may also enclose the centrifugal blower 122, however, the centrifugal blowers 122, 122*a*, 500 may also be positioned outside of the main housing 192.

The centrifugal blowers 122, 122*a*, 500 are operable to discharge an airflow through the one or more heat exchangers to provide the passenger compartment 186 with a conditioned airflow. One or more ventilation ducts 194 positioned throughout the passenger compartment 186 may guide the conditioned airflow to different locations in the passenger compartment 186. The ducts 194 may terminate as vents 198, which may be opened or closed to control the flow of conditioned airflow into the passenger compartment 186.

As shown in FIGS. 2–6, the hub 38, the plurality of blades 46, and the first shroud 66 are integrally formed as a single, one-piece fan 34. The fan 34 may be manufactured from a plastic material using a molding process, such as an injection molding process. The fan 34 may be molded as one piece using a relatively simple mold (not shown) separable into first and second mold halves that may be brought together or separated from one another along a mold axis 202 that is coaxial with the central axis 42. This is in contrast to conventional two-piece fans (not shown), which require multiple manufacturing steps before the final product is complete. Using such a relatively simple mold allows for decreased costs associated with manufacturing the fan 34.

The fan 34 may be molded such that at least a portion of the parting line between the mold halves is substantially perpendicular with respect to the mold axis 202. More particularly, such a portion of the parting line may extend across the blades 46 of the fan 34. With reference to FIG. 4, a mold line 206 is imprinted on the fan 34 by the parting line during the molding process, and a portion of the mold line 206 is shown extending across one of the blades 46. The exemplary mold line 206 of FIG. 4 is shown on a low-pressure surface 210 of the blade 46, extending from the first side edge 78 of the blade 46 substantially horizontally to the second side edge 82 of the blade 46, such that the mold line 206 forms an angle relative to the mold axis 202 of about 90 degrees. During the injection molding process, the first mold half may be responsible for forming a first portion of the low-pressure surfaces 210 of the blades 46 above the mold line 206, while the second mold half may be responsible for forming a second portion of the low-pressure surfaces 210 of the blades 46 below the mold line 206. Further, the first and second portions of the low-pressure surfaces 210 of the blades 46 may be joined at the parting line, which is indicated by the mold line 206 on the fan 34 of FIG. 4.

It should be noted that other portions of the fan 34 above the mold line 206 may be formed by the first mold half, while other portions of the fan 34 below the mold line 206 may be formed by the second mold half. However, in some constructions of the fan 34, the parting line between the first and second mold halves may not lie in a singular plane. In other words, other portions of the parting line not relating to the blades 46 may lie above the mold line 206, while other portions of the parting line not relating to the blades 46 may lie below the mold line 206.

By positioning the mold line 206 on the low-pressure surfaces 210 of the blades 46 as shown in the exemplary fan 34 of FIG. 4, the fan 34 may be manufactured with the three-dimensional blade forms as one-piece using a simple two-piece mold as discussed above. However, the mold line 206 may be positioned on the low-pressure surfaces 210 of the blades 46 in alternate orientations while still allowing the fan 34 to be manufactured as a single piece.

FIG. 4 also illustrates an alternate mold line 214 that may allow the fan 34 to be molded as a single piece. The alternate mold line 214 is shown in phantom to indicate an alternate orientation of the portion of the parting line corresponding with the blades 46. The alternate mold line 214 is shown at an oblique angle with respect to the mold axis 202. More particularly, the alternate mold line 214 forms an angle relative to the mold axis 202 of about 45 degrees. In such an orientation, the alternate mold line 214 may correspond with a transition line between the two-dimensional blade portion and the three-dimensional blade portion.

FIG. 4 further illustrates a second alternate mold line 218 that may allow the fan 34 to be molded as a single piece. The second alternate mold line 218 is also shown in phantom to indicate an alternate orientation of the portion of the parting line corresponding with the blades 46. More particularly, the second alternate mold line 218 forms an angle relative to the mold axis 202 of about 1 degree. The second alternate mold line 218 is nearly parallel with the mold axis 202, however, the about 1-degree draft angle is utilized to allow the fan 34 to release from the mold after it is formed. Although only two alternate mold lines 214, 218 are shown, the mold may be configured in any of a number of different ways such that the mold parting line imparts mold lines on the respective low-pressure surfaces 210 of the blades 46 between the alternate mold line 214 and the second alternate mold line 218.

With continued reference to FIG. 4, the mold line 206, the alternate mold line 214, and the second alternate mold line 218 on the low-pressure surface 210 of the blade 46 share a common point P. Point P is located on the first side edge 78 of the blade 46, at the intersection of the blade 46 and the first shroud 66. For the fan 34 to be molded as a single piece using a simple two-piece mold, as discussed above, point P may not be located substantially below the transition of the first shroud 66 from the cylindrical portion 86 to the bell portion 90. The geometry of the first and second mold halves substantially drives the constraint of point P. However, alternate orientations of the mold line 206 may be used with point P located above the transition of the first shroud 66 from the cylindrical portion 86 to the bell portion 90. Therefore, taking into account the limitations of the placement of point P, the mold line 206, or the portion of the parting line corresponding with the blades 46, may be oriented relative to the mold axis 202 between about 1 degree and about 90 degrees to allow the fan 34 to be molded as a single piece.

Relative to mold lines 222 formed on conventional forward-curved fans 10 (see FIG. 1*b*), the mold lines 206 of the fan 34 of FIG. 4 are substantially shorter in length. This is in contrast to a conventional fan 10, in which a portion of the parting line extends substantially the entire height of the blades 14 and substantially parallel to the mold axis 22. The one-piece backward curved fan 400 also requires a mold line portion substantially parallel to its mold axis.

For constructions of fans 34 utilizing a mold line 206 oriented relative to the mold axis 202 between about 45 degrees and about 90 degrees, the design of the mold for the fan 34 may be substantially less complex than a mold design for a conventional forward-curved fan 10 or a one-piece backward curved fan 400, and the maintenance required to maintain the parting line of the mold (i.e., to prevent substantial amounts of flash from occurring at the parting line, for example) may be substantially less than a mold design for a conventional forward-curved fan 10 or a one-piece backward curved fan 400.

I claim:

1. A centrifugal blower, comprising a centrifugal fan comprising:

a hub adapted for rotation about a central axis;

a first plurality of blades arranged about the central axis, wherein each of the blades defines a leading edge;

a trailing edge;

a first side edge extending between the leading edge and the trailing edge, the first side edge being swept from the leading edge in a direction axially away from the leading edge and radially outward toward the trailing edge;

a second side edge extending between the leading edge and the trailing edge, a portion of the second side edge integral with at least a portion of the hub, the second side edge being swept from the leading edge in a direction axially away from the leading edge and radially outward toward the trailing edge;

an inlet radius defined as an outermost radius of the blade leading edge;

a shroud integral with at least a portion of one of the first and second side edges of the first plurality of blades;

an intermediate radius defined as an innermost radius of the shroud;

a curvature in a first plane, the first plane extending through the blade and tangent to a cylinder which extends through the blade and is centered along the central axis, the cylinder being of a radius greater than a hub radius and less than the inlet radius; and no curvature in a second plane, the second plane extending through the blade and tangent to a cylinder which extends through the blade and is centered along the central axis, the cylinder being of a radius greater than the intermediate radius;

wherein the hub, the first plurality of blades, and the shroud are formed as one piece.

2. The centrifugal blower of claim 1, wherein the leading edges of the blades are substantially perpendicular to the central axis.

3. The centrifugal blower of claim 2, wherein the centrifugal fan is plastic injection molded.

4. The centrifugal blower of claim 2, wherein each of the blades comprises a skewed leading edge.

5. The centrifugal blower of claim 2, wherein each of the blades comprises a raked leading edge.

6. The centrifugal blower of claim 1, wherein the trailing edges of the blades are substantially parallel to the central axis.

7. The centrifugal blower of claim 1, wherein the shroud comprises a first shroud fixed to at least a portion of the respective first side edges of the first plurality of blades for rotation therewith, the first shroud shaped to follow at least a portion of a contour of the respective first side edges of the first plurality of blades.

8. The centrifugal blower of claim 7, further comprising a second plurality of blades arranged about the central axis, wherein the first shroud is integral with the second plurality of blades, the second plurality of blades having no curvature in a plane extending through the blades and tangent to a cylinder which extends through the blades and is centered along the central axis.

9. The centrifugal blower of claim 7, wherein the first shroud comprises a cylindrical portion.

10. The centrifugal blower of claim 9, wherein the cylindrical portion of the first shroud extends upstream of an intersection of the leading edge of the blade and the first side edge of the blade.

11. The centrifugal blower of claim 10, wherein the centrifugal fan is plastic injection molded.

12. The centrifugal blower of claim 10, wherein each of the blades comprises a skewed leading edge.

13. The centrifugal blower of claim 10, wherein each of the blades comprises a raked leading edge.

14. A centrifugal blower of claim 10, further comprising a blower housing substantially enclosing the fan, the blower housing defining an inlet opening, the blower housing comprising a first ring fixed to the blower housing and positioned around the inlet opening of the blower housing, the first ring coaxial with and inside of a cylindrical portion of the first shroud, the first ring at least partially axially overlapping the cylindrical portion of the first shroud, and a second ring fixed to the blower housing and positioned around the inlet opening of the blower housing, the second ring coaxial with and outside of the cylindrical portion of the first shroud, the second ring at least partially axially overlapping the cylindrical portion of the first shroud, a combination of the first ring, second ring, and the cylindrical portion of the first shroud defining a tortuous passageway to substantially restrict airflow discharged from the outlet of the fan from re-entering the inlet of the fan.

15. The centrifugal blower of claim 7, further comprising a second shroud fixed to at least a portion of the respective second side edges of at least some of the first plurality of blades for rotation therewith, the second shroud shaped to follow at least a portion of a contour of the respective second side edges of the first plurality of blades.

16. The centrifugal blower of claim 15, further comprising a second plurality of blades, wherein each of the second plurality of blades is integral with the second shroud, and wherein each of the second plurality of blades has no curvature in a plane, the plane extending through the blade and tangent to a cylinder which extends through the blade and is centered along the central axis.

17. The centrifugal blower of claim 15, wherein the second shroud is integral with at least a portion of the respective second side edges of the first plurality of blades.

18. The centrifugal blower of claim 7, wherein the centrifugal fan is plastic injection molded.

19. The centrifugal blower of claim 1, wherein the shroud is a second shroud integral to at least a portion of the respective second side edges of the first plurality of blades for rotation therewith, the second shroud shaped to follow at least a portion of a contour of the respective second side edges of the first plurality of blades.

20. The centrifugal blower of claim 19, further comprising a first shroud fixed to at least a portion of the respective first side edges of at least some of the first plurality of blades for rotation therewith, the first shroud shaped to follow at least a portion of a contour of the respective first side edges of the first plurality of blades.

21. The centrifugal blower of claim 20, further comprising a second plurality of blades, wherein each of the second plurality of blades is integral with the first shroud, and wherein each of the second plurality of blades has no curvature in a plane extending through the blades and tangent to a cylinder which extends through the blades and is centered along the central axis.

22. The centrifugal blower of claim 19, wherein the second shroud is integral with a second plurality of blades, the second plurality of blades having no curvature in a plane extending through the blades and tangent to a cylinder which extends through the blades and is centered along the central axis.

23. The centrifugal blower of claim 1, wherein the centrifugal fan is plastic injection molded.

24. The centrifugal blower of claim 1, wherein each of the blades comprises a skewed leading edge.

25. The centrifugal blower of claim 1, wherein each of the blades comprises a raked leading edge.

26. The centrifugal blower of any of claims 1 through 13, further comprising a first non-rotating shroud in a closely-spaced, facing relationship with a portion of the respective first side edges of the plurality of blades and shaped to follow a portion of a contour of the respective first side edges of the plurality of blades, the first non-rotating shroud positioned coaxial with the hub.

27. The centrifugal blower of claim 26, wherein the first non-rotating shroud has curvature in a plane that contains the central axis.

28. The centrifugal blower of any of claims 1 through 13, further comprising a second non-rotating shroud in a closely-spaced, facing relationship with at least a portion of the respective second side edges of the plurality of blades and shaped to follow at least a portion of a contour of the respective second side edges of the plurality of blades, the second non-rotating shroud positioned coaxial with the hub.

29. The centrifugal blower of claim 28, wherein the second non-rotating shroud has curvature in a plane that contains the central axis.

30. The centrifugal blower of claim 28, further comprising a blower housing substantially enclosing the fan, the blower housing defining an inlet and an outlet; wherein the second non-rotating shroud is fixed to the blower housing.

31. The centrifugal blower of claim 28, further comprising a blower housing substantially enclosing the fan, the blower housing defining an inlet and an outlet; a motor housing coupled to the blower housing; and a motor supported in the motor housing and comprising a drive shaft drivingly connected to the hub of the centrifugal fan; further comprising a flange at least partially supporting the motor housing on the blower housing, wherein the second non-rotating shroud is integral with the flange.

32. The centrifugal blower of claim 28, further comprising a blower housing substantially enclosing the fan, the blower housing defining an inlet and an outlet; a motor housing coupled to the blower housing; and a motor supported in the motor housing and comprising a drive shaft drivingly connected to the hub of the centrifugal fan; further comprising:

at least one electrical component operatively connected with the motor; and a heat sink thermally coupled with the at least one electrical component, the heat sink positioned in the second non-rotating shroud to receive a portion of an airflow generated by the fan to dissipate heat generated by the electrical component.

33. The centrifugal blower of claim 32, wherein the heat sink is embedded in the second non-rotating shroud substantially flush with the surface in facing relationship with the respective second side edges of the first plurality of blades.

34. The centrifugal blower of claim 1, wherein the portion of the hub integral with the second side edges of the first plurality of blades extends in a direction parallel to the central axis.

35. A centrifugal blower, comprising:

a centrifugal fan comprising a hub adapted for rotation about a central axis;

a plurality of blades arranged about the central axis and coupled for rotation with the hub, each of the blades defining a leading edge substantially perpendicular to the central axis;

a trailing edge substantially parallel to the central axis;

a first side edge extending between the leading edge and the trailing edge, the first side edge being swept from the leading edge in a direction axially away from the leading edge and radially outward toward the trailing edge;

a second side edge extending between the leading edge and the trailing edge, the second side edge at least partially integral with the hub, the second side edge being swept from the leading edge in a direction axially away from the leading edge and radially outward toward the trailing edge;

an inlet radius defined as the outermost radius of the blade leading edge;

a first shroud, the first shroud integral with at least a portion of the respective first side edges of the plurality of blades for rotation therewith, the first shroud comprising:

a cylindrical portion coaxial with the hub, the hub and cylindrical portion defining therebetween a substantially annular, axially-oriented inlet of the fan, the cylindrical portion extending upstream of an intersection of the leading edge of the blade and the first side edge of the blade;

a bell portion radially and axially extending from the cylindrical portion, the bell portion at least partially defining a substantially annular, radially outward-oriented outlet of the fan;

an intermediate radius defined as the innermost radius of the first shroud;

a curvature in a plane, the plane extending through the blade and tangent to a cylinder which extends through the blade and is centered along the central axis, the cylinder being of a radius greater than the hub radius and less than the inlet radius;

no curvature in a plane, the plane extending through the blade and tangent to a cylinder which extends through the blade and is centered along the central axis, the cylinder being of a radius greater than the intermediate radius;

a blower housing substantially enclosing the fan, the blower housing defining an inlet opening and a scroll defining an outlet;

a motor supported in the blower housing and comprising a drive shaft drivingly connected to the hub;

at least one electrical component operatively connected with the motor;

a second non-rotating shroud positioned in the blower housing coaxial with the hub, the second non-rotating shroud comprising a surface in closely spaced, facing relationship with the respective second side edges of the plurality of blades and shaped to follow a contour of the respective second side edges of the plurality of blades, the first shroud and second non-rotating shroud at least partially defining therebetween an air passageway between the inlet and outlet of the fan;

a heat sink positioned in the second non-rotating shroud and shaped to conform with the contour of the surface of the second non-rotating shroud, the heat sink thermally coupled with the at least one electrical component;

a first ring fixed to the blower housing and positioned around the inlet opening of the blower housing, the first ring coaxial with and inside of the cylindrical portion of the first shroud, the first ring at least partially axially overlapping the cylindrical portion of the first shroud; and a second ring fixed to the blower housing and positioned around the inlet opening of the blower housing, the second ring coaxial with and outside of the cylindrical portion of the first shroud, the second ring at least partially axially overlapping the cylindrical portion of the first shroud, a combination of the first ring, second ring, and the cylindrical portion of the first shroud defining a tortuous passageway to substantially restrict airflow discharged from the outlet of the fan from re-entering the inlet of the fan.

* * * * *